US007775252B2

(12) United States Patent
Snyder et al.

(10) Patent No.: US 7,775,252 B2
(45) Date of Patent: Aug. 17, 2010

(54) VERTICALLY MOVABLE DOOR WITH SAFETY BARRIER

(75) Inventors: Ronald P. Snyder, Dubuque, IA (US); Jason D. Miller, Monmouth, IA (US); Donald P. Grant, Dubuque, IA (US); Paul J. Maly, Mequon, WI (US); Joseph A. Manone, Mequon, WI (US); Daniel M. Anderson, Oak Creek, WI (US); Ronald W. Bennett, Leesburg, GA (US); Mark G. Petri, Mequon, WI (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 780 days.

(21) Appl. No.: 11/339,152

(22) Filed: Jan. 25, 2006

(65) Prior Publication Data

US 2007/0079942 A1 Apr. 12, 2007

Related U.S. Application Data

(63) Continuation-in-part of application No. 11/012,424, filed on Dec. 14, 2004.

(51) Int. Cl.
*E06B 3/48* (2006.01)

(52) U.S. Cl. ..... 160/113; 160/201; 52/173.2; 49/9

(58) Field of Classification Search ..... 160/113, 160/127, 201, 205, 209, 265, 84.06, 273.1, 160/41; 49/9, 34, 65, 6; 52/173.2
See application file for complete search history.

(56) References Cited

U.S. PATENT DOCUMENTS

| | | | |
|---|---|---|---|
| 1,357,106 | A | 10/1920 | McLellan |
| 1,652,186 | A | 12/1927 | Strauss |
| 1,666,508 | A | 4/1928 | Sawyer |
| 2,072,092 | A | 3/1937 | Blodgett |
| 2,088,046 | A | 7/1937 | White |
| 2,237,106 | A | 4/1941 | Minert |
| 2,295,205 | A | 9/1942 | Fraser |

(Continued)

OTHER PUBLICATIONS

Gaylord Material Handling, Dock Strap, Web page advertising DockStrap(™) product, dated May 14, 2002, 1 page.

(Continued)

*Primary Examiner*—David Purol
(74) *Attorney, Agent, or Firm*—Hanley, Flight & Zimmerman, LLC

(57) ABSTRACT

A vertically moving door of a truck loading dock includes a disconnectable horizontal joint that provides the door with a barrier position, wherein an upper section of the door can be separated from a lower section to create a ventilation area between the two. The ventilation area allows fresh outside air to enter the building, while the lower section remains at its lowermost position for safety and security. More specifically, the lower section serves as a barrier that helps prevent someone or something from accidentally falling through the doorway when a truck is not present at the dock. A lightweight, resilient strap can be attached to the lower section of the door to help protect that section from an otherwise damaging impact. A lattice of straps or a mesh can be installed across the ventilation area to help secure the building against theft.

21 Claims, 33 Drawing Sheets

U.S. PATENT DOCUMENTS

| | | | | |
|---|---|---|---|---|
| 2,378,004 | A | | 6/1945 | Duell |
| 2,689,004 | A | * | 9/1954 | Der Horst ..... 160/269 |
| 3,021,896 | A | | 2/1962 | Buono et al. |
| 3,292,685 | A | * | 12/1966 | Clark ..... 160/26 |
| 4,356,668 | A | | 11/1982 | Wagner |
| 4,378,043 | A | | 3/1983 | Sorenson |
| 4,429,729 | A | | 2/1984 | Winslow |
| 4,653,566 | A | | 3/1987 | Miale |
| 4,920,598 | A | | 5/1990 | Hahn |
| 5,005,827 | A | | 4/1991 | Steinbrecher |
| 5,029,819 | A | | 7/1991 | Kane |
| 5,040,258 | A | | 8/1991 | Hahn et al. |
| 5,046,544 | A | * | 9/1991 | Coluccio ..... 160/201 |
| 5,050,846 | A | | 9/1991 | Goodman et al. |
| 5,118,056 | A | | 6/1992 | Jeanise |
| 5,170,829 | A | | 12/1992 | Duncan et al. |
| 5,408,789 | A | | 4/1995 | Plfeger |
| 5,459,963 | A | | 10/1995 | Alexander |
| 5,503,211 | A | | 4/1996 | Engi |
| 5,505,244 | A | | 4/1996 | Thumann |
| 5,564,238 | A | | 10/1996 | Ellis |
| 5,584,333 | A | | 12/1996 | Torchetti et al. |
| 5,611,382 | A | | 3/1997 | Sferra |
| 5,624,203 | A | | 4/1997 | Jackson et al. |
| 5,636,679 | A | | 6/1997 | Miller et al. |
| 5,649,396 | A | | 7/1997 | Carr |
| 5,660,144 | A | | 8/1997 | Venti |
| 5,727,614 | A | | 3/1998 | Lichy |
| 5,823,705 | A | | 10/1998 | Jackson et al. |
| 5,848,630 | A | | 12/1998 | Manzo |
| 5,860,465 | A | | 1/1999 | Eastridge et al. |
| 5,904,199 | A | | 5/1999 | Messner |
| 5,927,368 | A | | 7/1999 | Rohrer et al. |
| 6,092,580 | A | | 7/2000 | Lucas |
| 6,186,274 | B1 | | 2/2001 | Reynolds et al. |
| 6,279,276 | B1 | | 8/2001 | Knoll |
| 6,283,427 | B1 | | 9/2001 | Moller et al. |
| 6,315,027 | B1 | | 11/2001 | Lichy |
| 6,375,164 | B1 | | 4/2002 | Siegler et al. |
| 6,375,165 | B1 | | 4/2002 | Sherratt et al. |
| 6,485,225 | B1 | | 11/2002 | Baker |
| 6,536,502 | B2 | | 3/2003 | Britto et al. |
| 6,557,614 | B1 | | 5/2003 | Lampers |
| 6,575,435 | B1 | | 6/2003 | Kotzen |
| 6,595,496 | B1 | | 7/2003 | Langlie et al. |
| 6,615,898 | B2 | * | 9/2003 | Schulte ..... 160/201 |
| 6,655,442 | B2 | | 12/2003 | Snyder |
| 6,688,480 | B1 | | 2/2004 | Denny |
| 6,733,204 | B1 | | 5/2004 | Paniccia |
| 6,776,398 | B1 | | 8/2004 | Tsai |
| 6,807,999 | B1 | | 10/2004 | Bowen et al. |
| 2003/0016996 | A1 | | 1/2003 | Gelfand et al. |
| 2003/0079845 | A1 | | 5/2003 | Stern, Jr. |

OTHER PUBLICATIONS

Engination LLC, Engination Product Brochure showing safety products of JD Metalworks, dated Jul. 9, 2003, 8 pages.

International Searching Authority, "International Search Report", in connection with PCT application Serial No. PCT/US2005/045279, mailed Jun. 17, 2008 (4 pages).

International Searching Authority, "Written Opinion of the International Searching Authority", in connection with PCT application Serial No. PCT/US2005/045279, mailed Jun. 17, 2008 (4 pages).

International Bureau, International Preliminary Report on Patentability, issued in connection with international application serial No. PCT/US2005/045279, issued Mar. 3, 2009, 5 pages.

United States Patent and Trademark Office, "Final Office Action, " issued in connection with U.S. Appl No. 11/012,424, mailed Jul. 22, 2009, 13 pages.

United States Patent and Trademark Office, "Notice of Non-Compliant Amendment," issued in connection with U.S. Appl No. 11/012,424, mailed Feb. 9, 2009, 2 pages.

United States Patent and Trademark Office, "Non-Final Office Action," issued in connection with U.S. Appl No. 11/012,424, mailed Jun. 2, 2008, 18 pages.

United States Patent and Trademark Office, "Restriction Requirement," issued in connection with U.S. Appl No. 11/012,424, mailed Feb. 25, 2008, 5 pages.

United States Patent and Trademark Office, "Non-Final Office Action," issued in connection with U.S. Appl No. 11/012,424, mailed Nov. 25, 2009, 5 pages.

State Intellectual Property Office of China, English Translation of "First Office Action," issued in connection with Chinese application serial No. 200580042845.6, issued Mar. 18, 2010, 8 pages.

* cited by examiner

VERTICALLY MOVABLE DOOR WITH SAFETY BARRIER

This application is a continuation-in-part of U.S. application Ser. No. 11/012,424, filed Dec. 14, 2004.

FIELD OF THE DISCLOSURE

The subject invention generally pertains to vertically movable doors and more specifically to a door that is particularly suitable for use at a truck loading dock or other location where ventilation, safety or security may be important.

BACKGROUND

Many buildings may have a doorway with a loading dock to facilitate transferring cargo between a truck and the building. A loading dock is a platform that is generally at the same elevation as the bed of the truck or its trailer. The dock may also include a dock leveler, which is a vertically movable ramp that compensates for a height differential that may exist between the platform and the truck bed. Dock levelers may also provide a bridge across which personnel and material handling equipment can travel between the platform and the truck.

For protection against weather and theft, the doorway of the building may include a manual or power operated door. Doors for loading docks usually open and close by moving vertically so as not to interfere with the rear of the truck or interfere with cargo and activity just inside the doorway.

When there is no truck at the dock and the weather is mild, the door may be left open to help ventilate the building with fresh outside air. Leaving the door open, however, reduces the building's security and increases the risk of personnel or items inside the building from accidentally falling off the edge of the dock's platform and through the open doorway to the driveway. But even with the door closed, heavy material handling equipment, such a forklift truck, may have enough power or momentum to accidentally break through the door and still fall off the edge.

Barriers of various types are used in a loading dock environment to prevent the accidental run-off noted above. In fact, some loading dock levelers feature extended lips that can provide a run-off barrier when the leveler is in an inoperative position, but these barrier-style levelers do not protect the loading dock door from impact when the door is closed because the extended lip is outside of the door. Examples of barrier-style dock levelers can be seen in U.S. Pat. Nos. 4,920,598 and 5,040,258. Other barriers, such as a simple safety gate better protect the loading dock door, but they are typically manually activated or require a separate operational step to position the barrier. Examples of a gate-type barrier are the Rite-Hite Dok Guardian product and the inventions disclosed in U.S. Pat. Nos. 5,459,963 and 5,564,238.

A variety of other patents are directed to loading dock door systems. U.S. Pat. No. 5,408,789, for example, discloses a unique loading dock door system that automatically places a barrier to both prevent run-off and protect the door, itself, from impact. The patented system may not only include what appears to be a conventional vertically moving door, but also an additional screen door for ventilation and security. For run-off protection and to protect the screen door from impact, a safety barrier (which appears to be a rigid bar) is attached to the screen door. A system of this type, in which the barrier is automatically placed when the door is closed, provides the additional convenience of not requiring an operator to perform an additional operation (in the case of a manually positioned barrier) or an additional driving mechanism (in the case of an automatically positioned barrier) to position the barrier. Further, the system ensures that the barrier is always in place when the door is closed, thus ensuring protection of the door from impact damage. However, because the barrier travels with the door, it is also removed when the door is opened, leaving no run-off protection. Further, the system actually includes two doors with two sets of tracks, which is likely more expensive than a single door. The two doors also take up more floor space in a loading dock area where floor space is often limited. The rigid bar disclosed in this system would also be subject to permanent deformation when impacted by a fork truck or similar conveyance.

In another attempt to provide ventilation to a sectional door, the system disclosed in U.S. Pat. No. 6,092,580, includes a screened gate that can be selectively attached or removed from the lowermost panel of a garage door. Because the screened gate is not part of the garage door itself, it does not have its own rollers for traveling along the door's tracks. Instead, the gate is either attached to the frame of the doorway using Velcro strips (FIG. 6), or the gate stows against the inside face of the lowest door panel (FIG. 11). The screened gate can also be manually detached from the door and left on the ground (attached to the doorway frame with Velcro) to provide a barrier for pets and children. Although it may be an effective system for its intended purpose of providing a barrier to pets and children, while also providing them with ventilation, such a system would be unacceptable for use at a loading dock for several reasons.

First, an industrial barrier for impeding forklifts at a loading dock generally needs to be relatively strong, particularly at floor level where the forklifts travel. With the '580 system, however, the screen, which appears to be one of the weaker members of the door, is placed at the very bottom of the door to serve as a barrier, while the more solid door panels are higher up.

Second, vertically moving sectional doors (e.g., garage doors) typically have a spring-loaded system for counterbalancing the weight of the door panels, thereby making the door easier to operate. Adding or removing weight from the door by selectively attaching or disconnecting a panel can change the weight equilibrium of the door. Depending on whether weight is added or removed, the door may have a strong bias to open or close. This may not be a problem for the '580 system, because the screened gate appears to be relatively lightweight, but a much heavier panel is needed to stop a forklift. Adding or removing the weight of a heavy, truck-stopping panel from an industrial door may cause the door to fling open or close abruptly.

SUMMARY

In some embodiments, a vertically moving door includes a separable horizontal joint that enables the door to selectively move to a closed position, a barrier position and an open position.

In some embodiments, the separable horizontal joint, when intact, provides a pivotal connection between an upper and lower section of the door.

In some embodiments, the separable horizontal joint creates a ventilation area between the upper and lower sections of the door, and for security or for providing a barrier to insects, a screen or a lattice of straps extends across the ventilation area.

In some embodiments, a counterbalance, such as a spring or deadweight, helps compensate for the weight change caused by separating or reconnecting the lower section of the door to the upper section.

In some embodiments, a winch, hoist or chainfall helps separate and/or reconnect the upper and lower door sections in a controlled manner.

In some embodiments, a mechanically actuated latch at the horizontal joint helps hold the upper and lower sections of the door together.

In some embodiments, an electrically actuated latch at the horizontal joint helps hold the upper and lower sections of the door together.

In some embodiments, a latch helps hold the lower section of the door down when the upper section is raised for ventilation.

In some embodiments, a resilient, shock-absorbing barrier is attached to a vertically moving door.

In some embodiments, a strap held in tension serves as the resilient, shock-absorbing barrier.

In some embodiments, an existing conventional door is modified as a horizontally split door.

In some embodiments, an existing conventional door is modified to include a resilient, shock-absorbing barrier.

In some embodiments, an adjustable bracket attaches a barrier to a door panel.

In some embodiments, a door-mounted barrier lowers into an abutment that includes a pinch guard.

In some embodiments, an abutment includes an angled lead-in that helps guide a door-mounted barrier into the abutment.

In some embodiments, a door-mounted barrier includes a strap that can be tightened by an indexable device that employs a removable lever arm.

In some embodiments, a door-mounted barrier includes a shear pin that helps avoid costly damage in the event of a severe impact.

DETAILED DESCRIPTION

Figure 1:
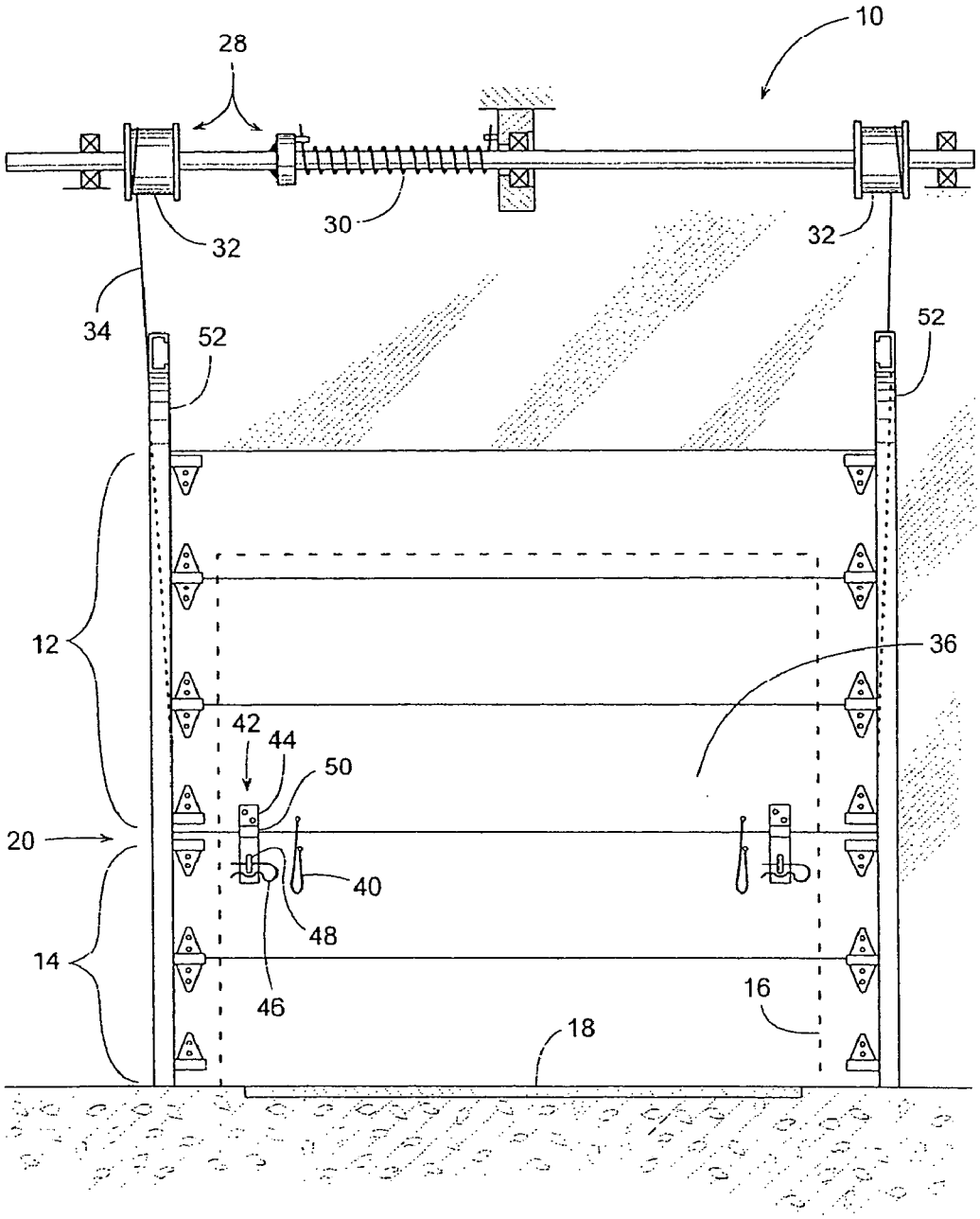
FIG. 1 is a front view of a closed door as viewed from inside the building.
Figure 2:
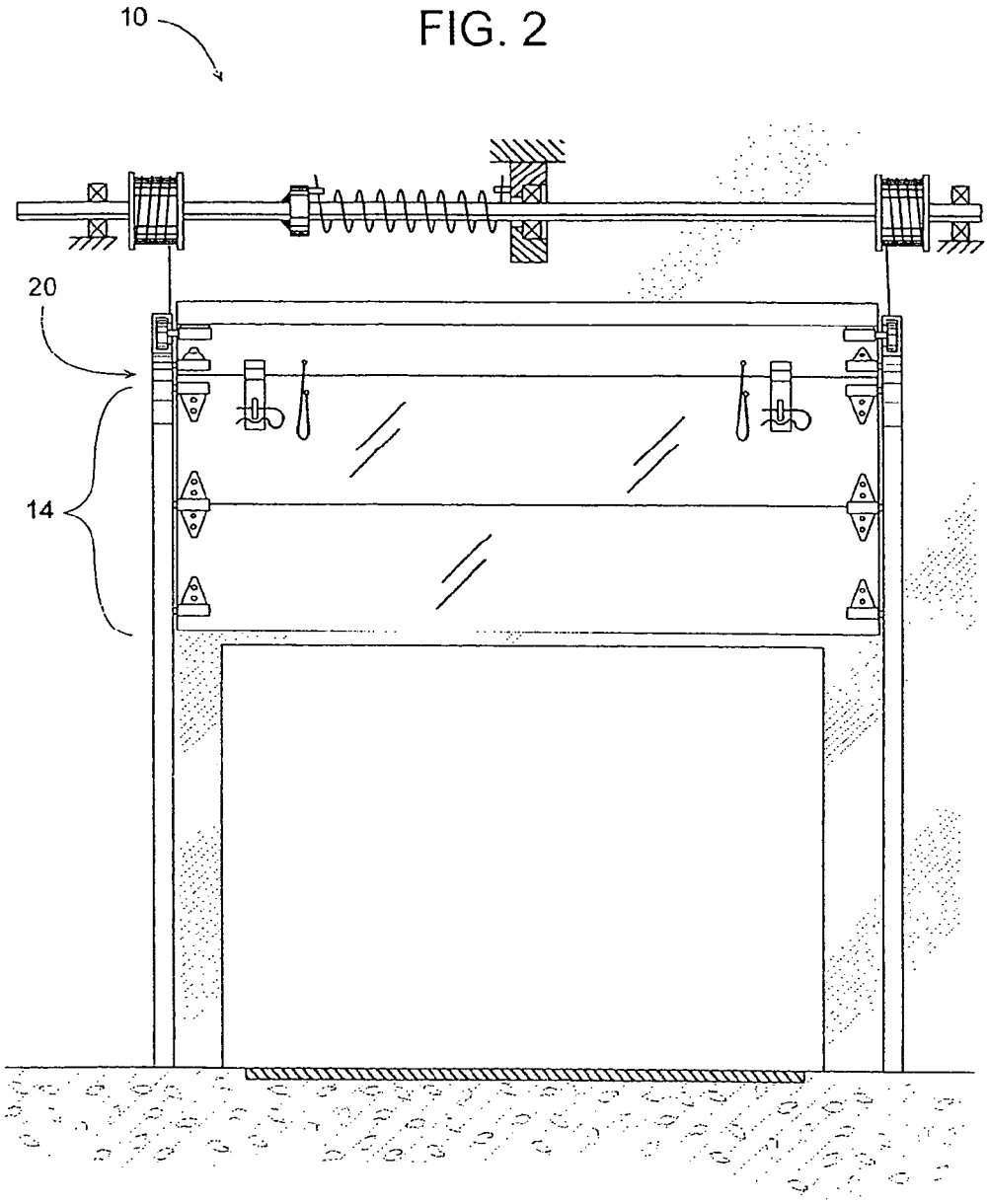
FIG. 2 is a front view similar to FIG. 1 but showing the door at its open position.
Figure 3:
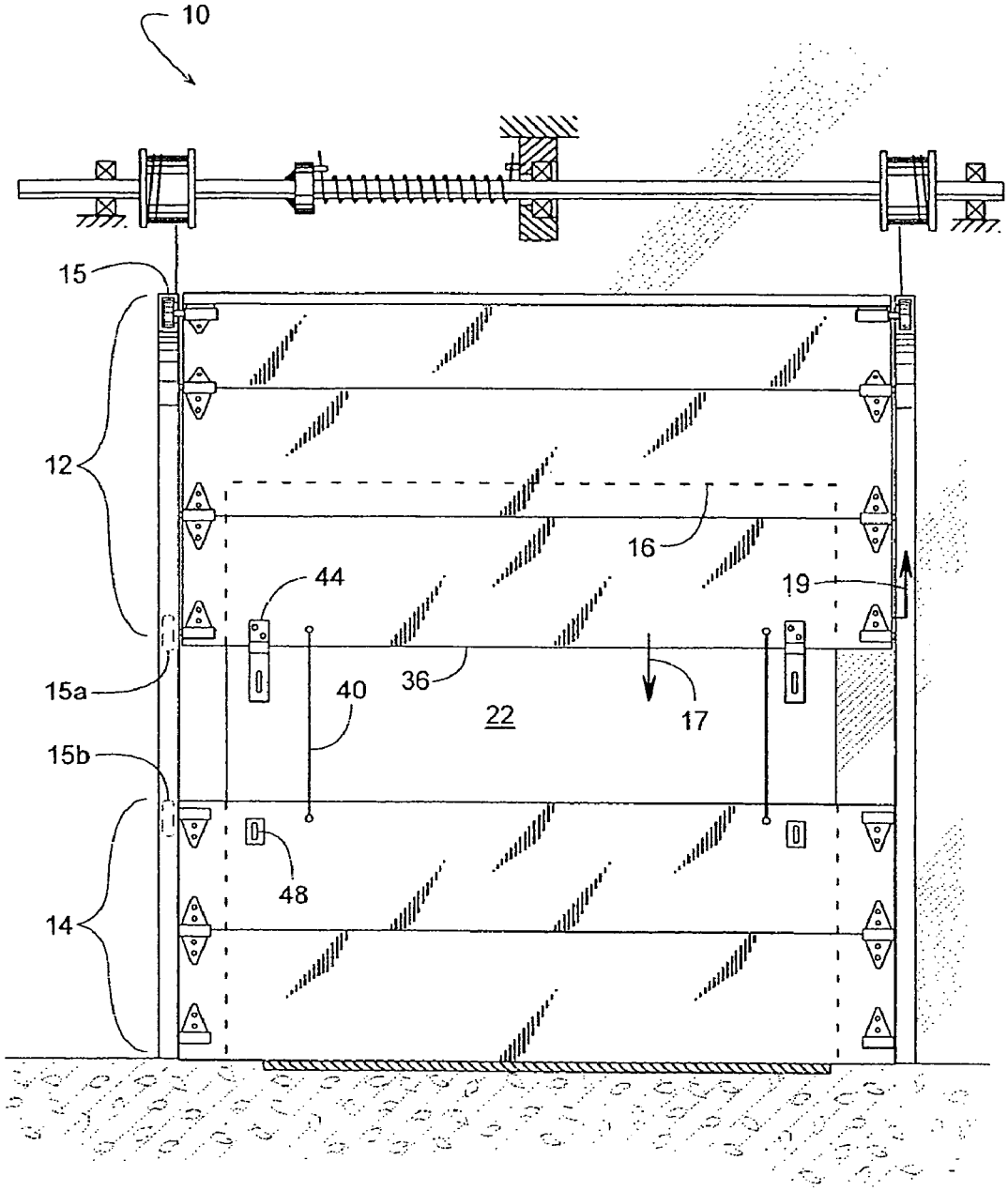
FIG. 3 is a front view similar to FIGS. 1 and 2, but showing the door at its barrier position and creating a ventilation area between an upper and lower section of the door.

FIGS. 1-3 show a door 10 with an upper section 12 and a lower section 14 that are vertically movable to selectively open up and close off a doorway 16. Doorway 16 is for a loading dock, which in this example happens to have a dock leveler 18 (see also FIGS. 6 and 7). The drawing figures show the door as it would appear from inside the building looking out. FIG. 1 shows door 10 at its closed position, and FIG. 2 shows door 10 at its open position.

To provide security and safety when lower section 14 is at its fully lowered position and no truck is present while simultaneously allowing the benefit of fresh air ventilation, door 10 can be moved to a barrier position, as shown in FIG. 3. The barrier position is made possible by a disconnectable joint 20 that enables upper section 12 to separate and lift away from lower section 14, thereby creating a ventilation area 22 between the two. The structural details of disconnectable joint 20 will be explained later. With door 10 at its barrier position, area 22 permits outside air to pass through the doorway.

Moreover, with lower section 14 at its fully lowered position, section 14 serves as a barrier that helps prevent material handling equipment, personnel or items on the dock platform from accidentally falling through the doorway and onto the driveway and further provides a level of security that helps prevent intruders from entering the building. Lower section 14 can serve as a barrier in itself without the need for additional impact-absorbing structure because lower section 14 is part of the door that is already engaged within a set of tracks 52. Moreover, lower section 14 is preferably tougher and more resilient than upper section 12 so that lower section 14 can provide an effective impact-resistant barrier (as seen in U.S. Pat. No. 6,655,442).

Accordingly, closing of the door 10 automatically places a barrier (lower panel 14) in a position to prevent runoff of personnel or equipment. The door can then be partially opened while leaving the barrier in place by separating the disconnectable joint 20 and raising the upper section(s) 12. The benefit of automatically placing a run-off barrier, leaving the barrier in place, and at least partially opening the door, is thus obtained.

Figure 4:
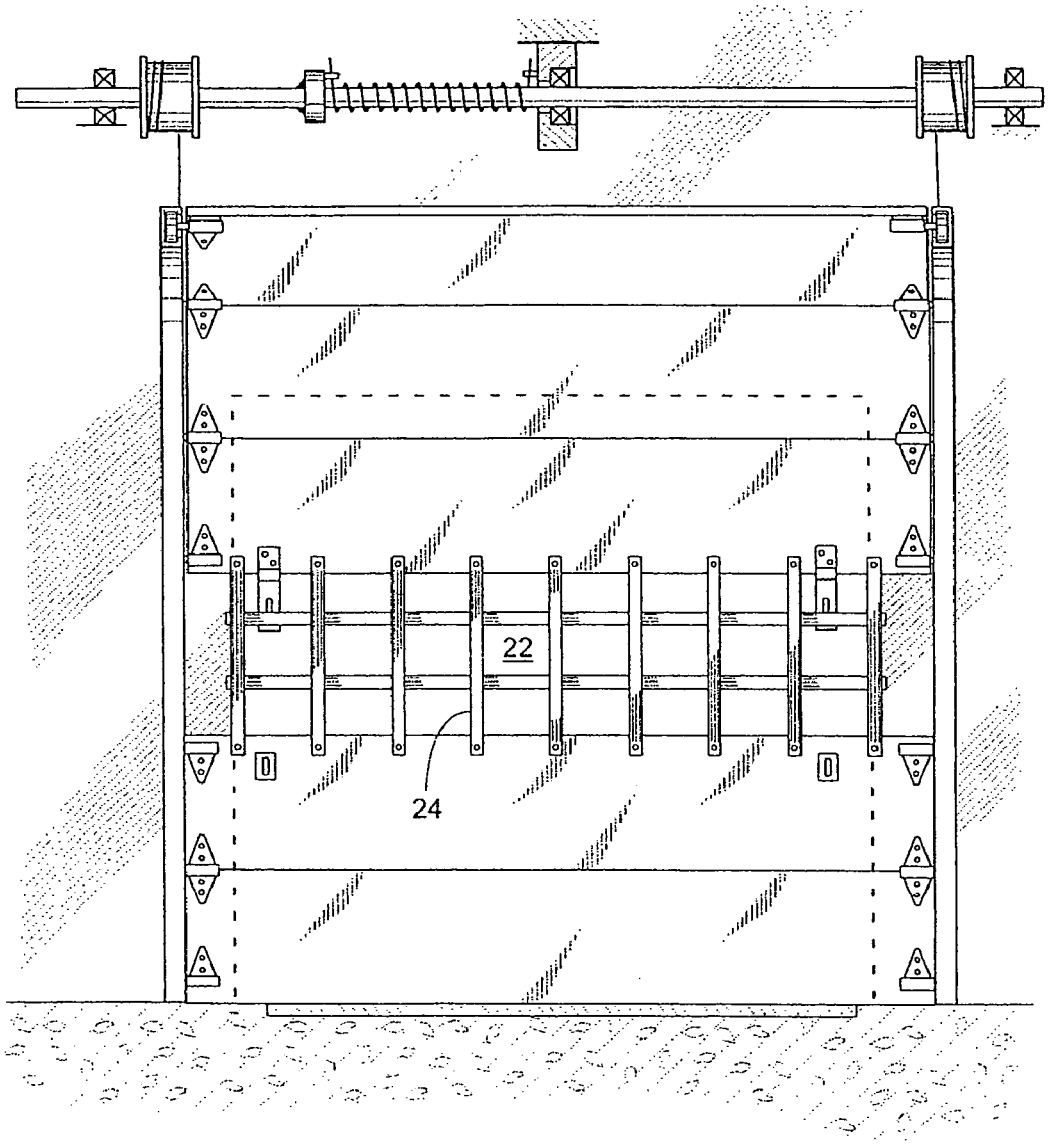
FIG. 4 is a front view showing a plurality of straps extending across the ventilation area of the door.
Figure 5:
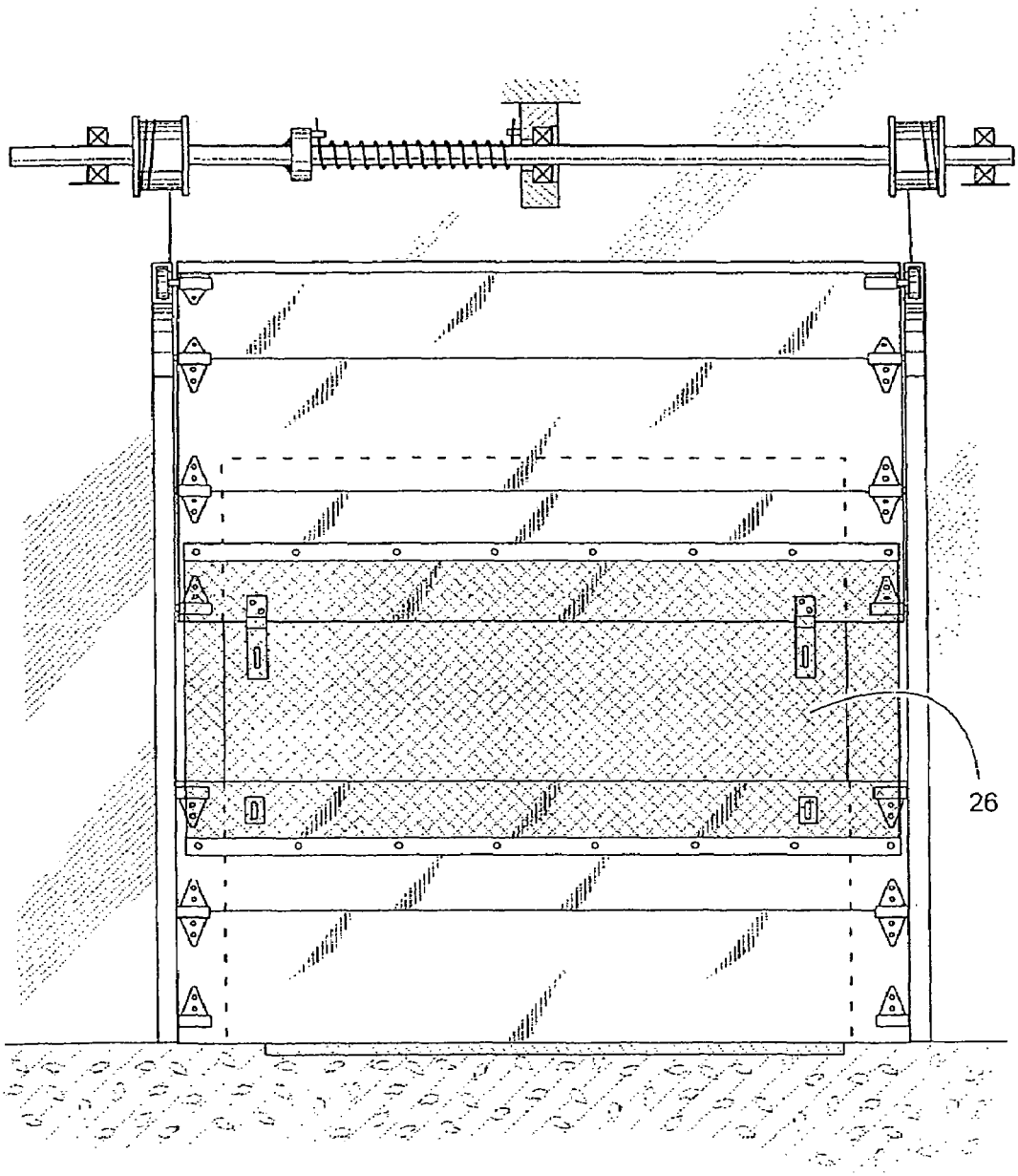
FIG. 5 is a front view showing a screen mesh extending across the ventilation area of the door.

For greater security or to prevent insects from passing through ventilation area 22, a lattice of pliable straps 24 (FIG. 4) or a screen 26 (FIG. 5) can be attached to upper and lower sections 12 and 14 to cover area 22. In some embodiments, however, straps 24 or screen 26 could be replaced by a cable, chain, belting, fabric, etc. or just simply eliminated altogether without replacing it with anything else.

Figure 6:
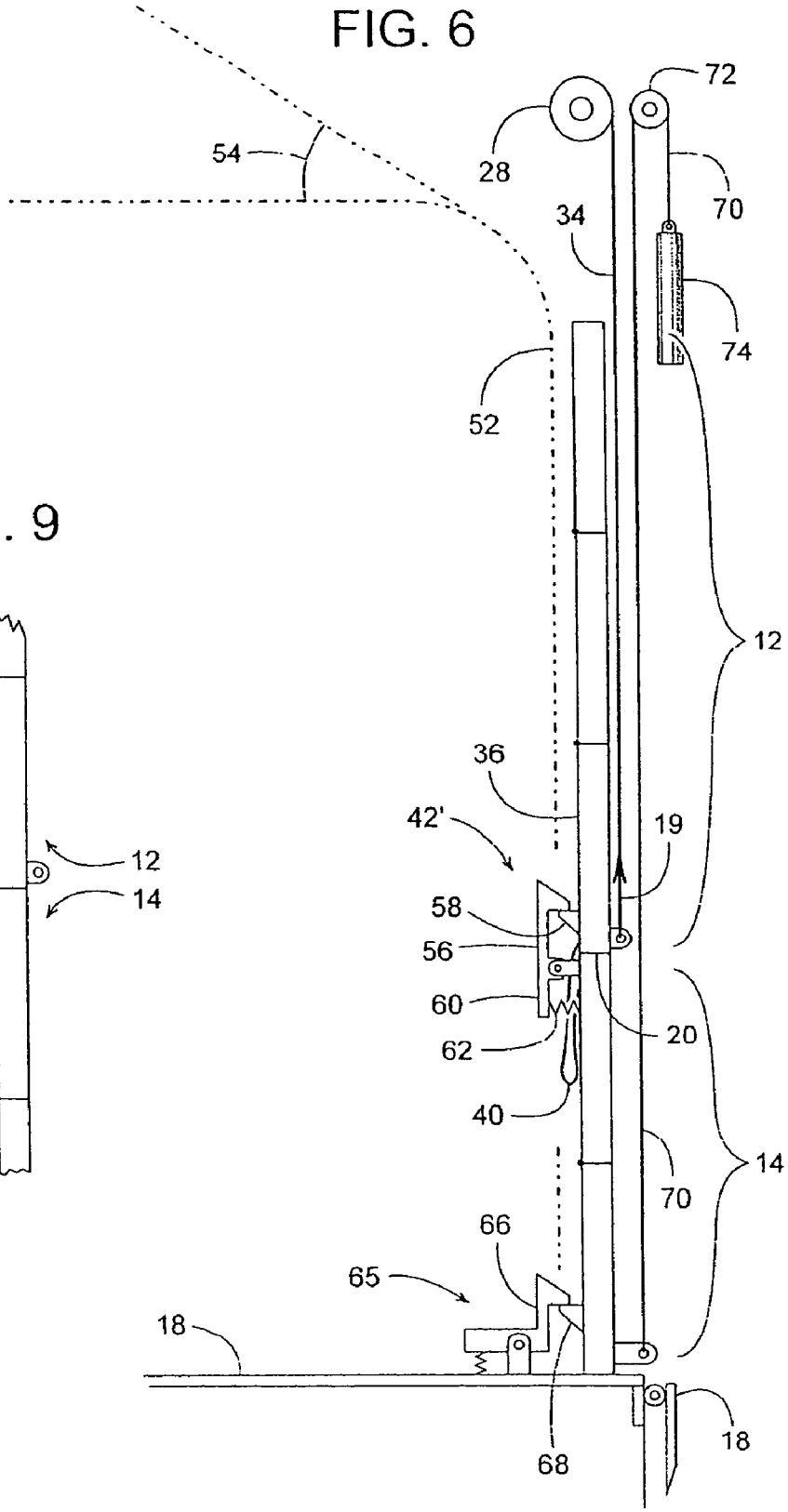
FIG. 6 is a schematic side view of a door at its closed position.
Figure 7:
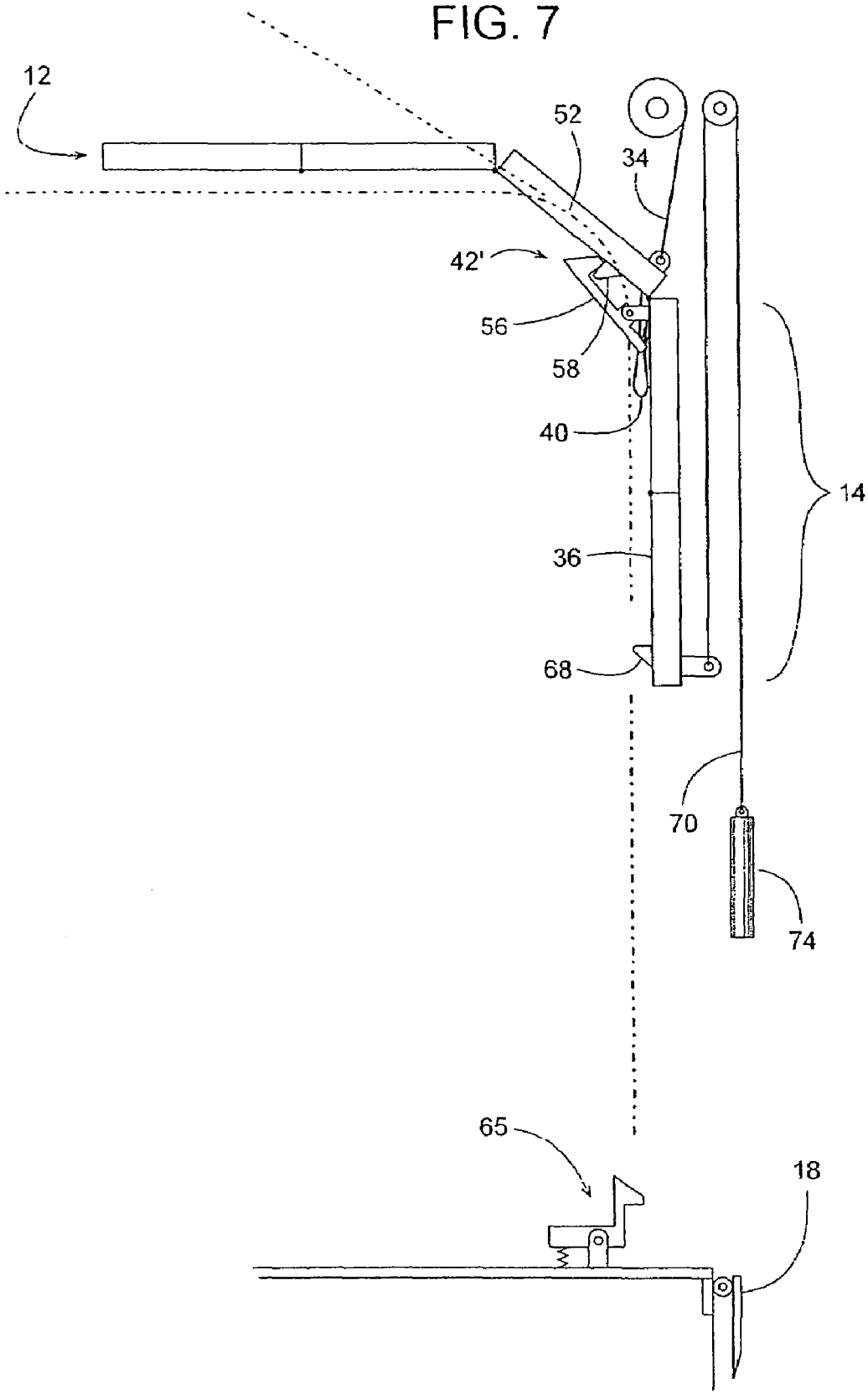
FIG. 7 is a schematic side view similar to FIG. 6 but showing the door at its open position.
Figure 8:
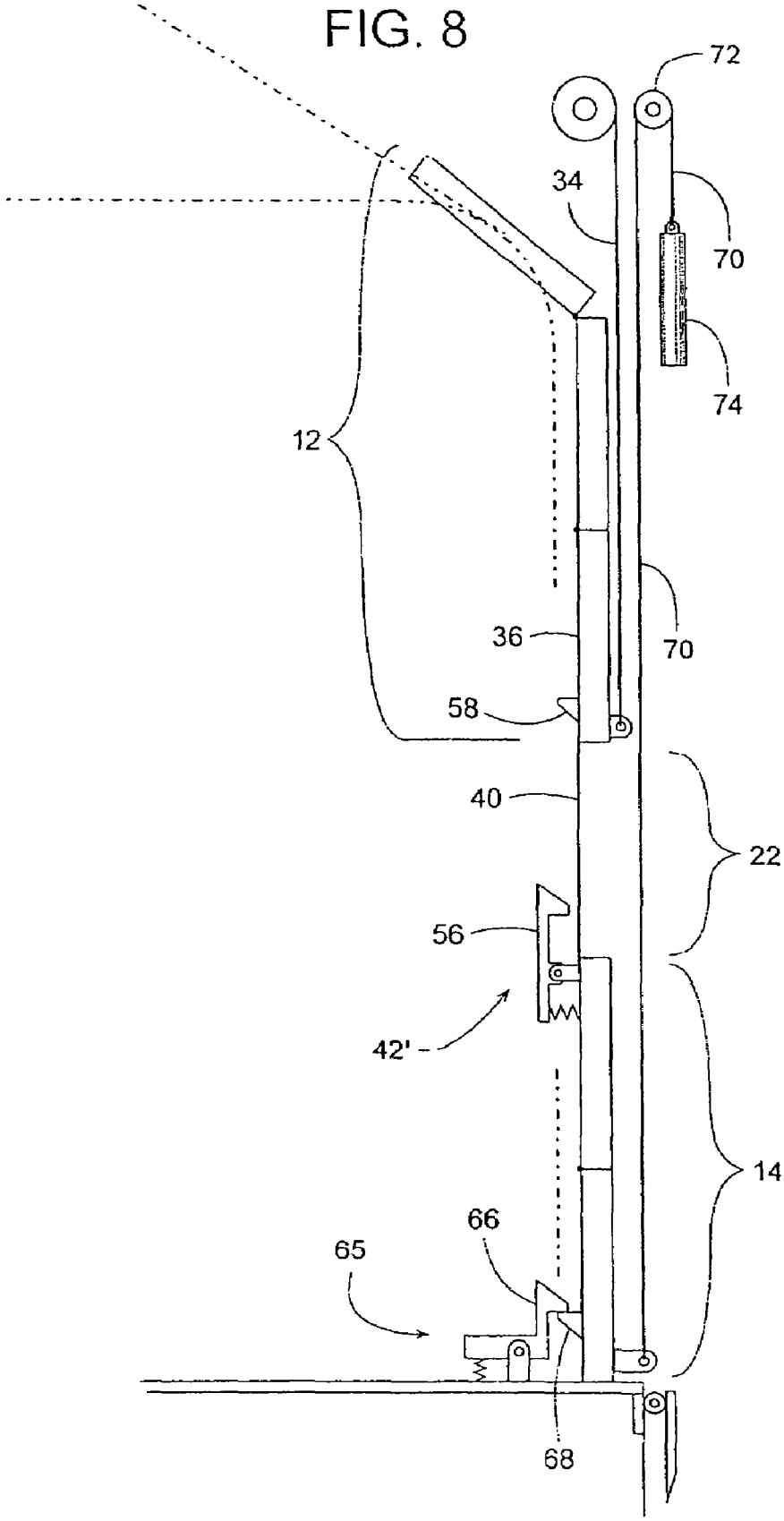
FIG. 8 is a schematic side view similar to FIGS. 6 and 7 but showing the door at its barrier position.

Straps 24 and screen 26 may also serve as a separation-limiting member. Door 10, for example, may have a counterbalance 28 for offsetting the combined weight of the upper and lower sections 12 and 14, whereby counterbalance 28 reduces the lifting force needed to open the door. Counterbalance 28 could be a counterweight or a torsion spring 30 acting upon one or more take-up drums 32, wherein a cable 34 (elongate member) on the drums connects to a lowermost panel 36 of upper section 12 (FIGS. 6-8). The tension in cable 34 exerts an upward force 19 against upper section 12. When upper section 12 rises from the closed position of FIG. 1 to the barrier position of FIG. 3, the full power of counterbalance 28 only carries the weight of upper section 12, which of course is lighter than the combined weight of sections 12 and 14. Consequently, counterbalance 28 may overpower the lifting of upper section 12 and tend to lift upper section 12 all the way up or lift it in an uncontrolled manner. To prevent this from happening, straps 24 or screen 26 may serve to compensate for the door weight differential that exists between the separated and unseparated conditions of the door by providing a restraint or separation-limiting member that can limit the distance that upper section 12 can lift away from lower section 14. When door 10 is at its barrier position of FIG. 3, the tension in the separation-limiting member exerts a downward force 17 against upper section 12.

Referring back to FIGS. 1-3, if security and insects are not a concern, the function of compensating for the separated/unseparated weight differential of the door can be performed by a separation-limiting member between sections 12 and 14 in the form of a simple elongate member 40, such as a cable or chain, instead of screen 26 or straps 24. If a drive unit powers the door open, it is conceivable that elongate member 40, screen 26 and straps 24 could all be omitted, and the drive unit itself could limit the distance that upper section 12 lifts away from lower section 14 thus compensating for the weight difference caused by releasing the lower section 14.

Another method of compensating for the weight differential caused by separation of the door, and for preventing counterbalance 28 from overpowering the lifting of upper section 12 when the weight of lower section 14 is removed, is to include a deadweight (not shown) that can be automatically or manually added to upper section 12 when the lower section is not being lifted and automatically or manually removed when the upper and lower sections are lifted together. Alternatively, a cable 70 (second elongate member) connected to lower section 14 and supported by a roller 72 can suspend a deadweight 74 to offset the weight of lower section 14 (i.e., deadweight 74 and lower section 14 weigh approximately the same). In this way, connecting or disconnecting lower section 14 from upper section 12 makes a negligible difference to the overall weight that counterbalance 28 needs to offset. Thus, counterbalance 28 can be adjusted to carry just the weight of upper section 12 alone.

Figure 10:
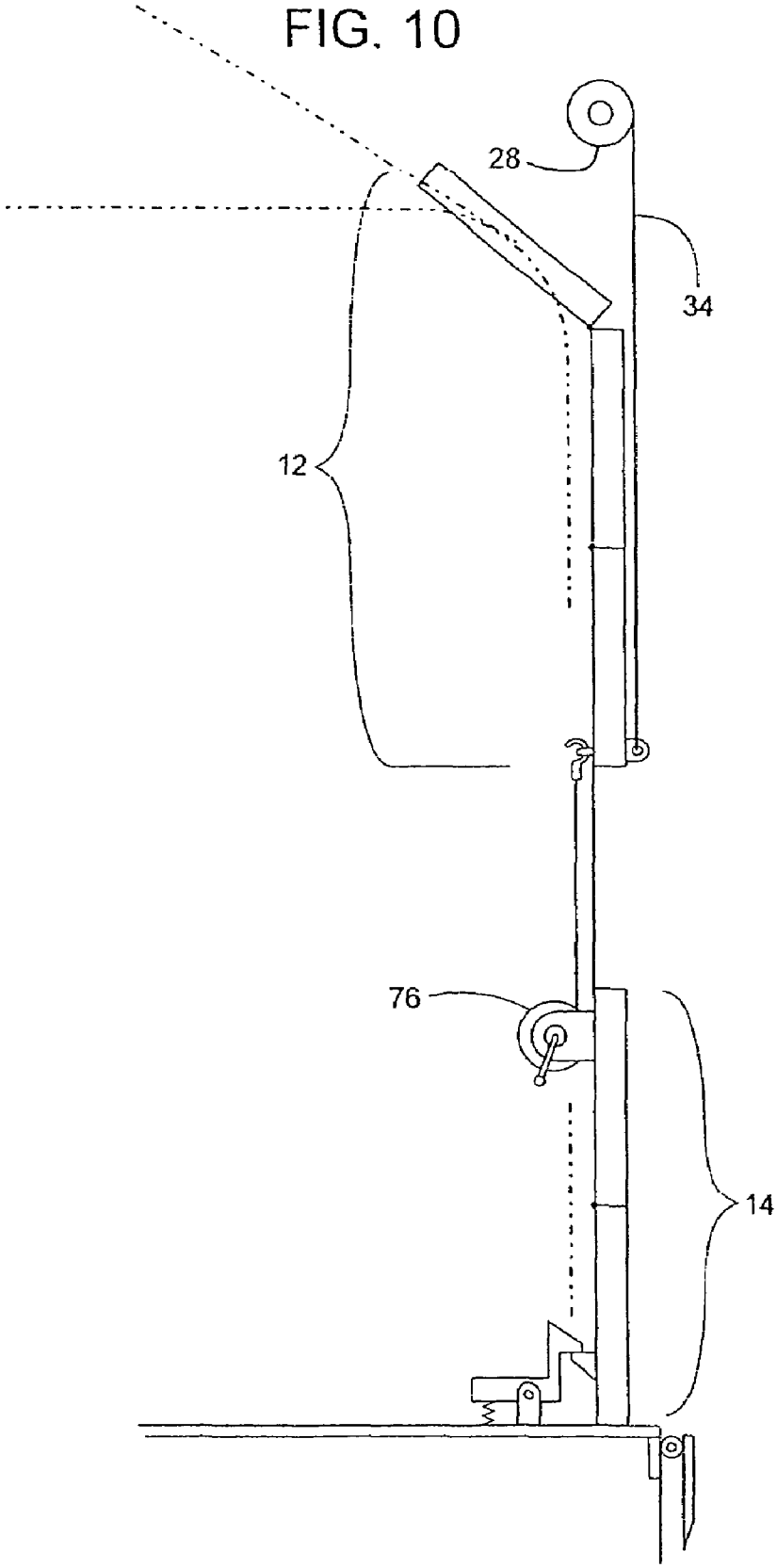
FIG. 10 is a schematic side view similar to FIG. 9 but with a winch installed to assist in moving the door's upper and lower sections together or apart.

Installing a winch 76 between sections 12 and 14, as shown in FIG. 10, is another option for compensating for the weight differential created by adding or removing the weight of lower section 14. When counterbalance 28 is adjusted to offset the full combined weight of sections 12 and 14, winch 76 allows counterbalance 28 to lift upper section 12 away from lower section 14 in a more controlled manner. More specifically, counterbalance 28 can lift upper section 12 no faster than what winch 76 allows because the friction and internal spring of winch 76 provide a downward force that mimics the weight of section 14.

Figure 11:
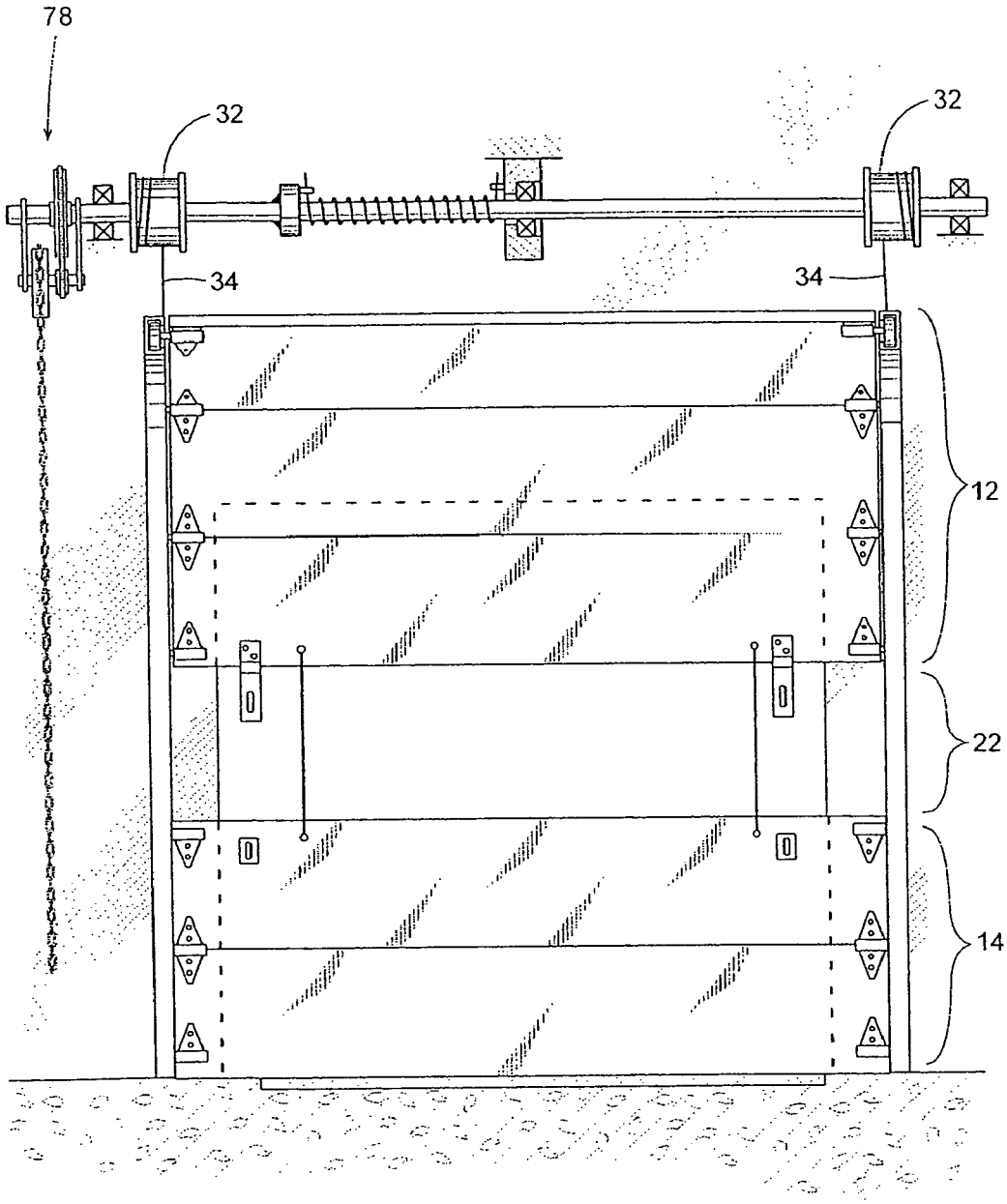
FIG. 11 is a front view similar to FIG. 3 but with a hoist installed to assist in moving the door's upper and lower sections together or apart.

Referring to FIG. 11, yet another alternative for controllably separating and reconnecting sections 12 and 14 is to install a hoist 78, such a conventional manually operated chainfall, that helps control the rotational speed and direction of counterbalance drums 32, which in turn carry the cables 34 that connect to upper section 12. Hoist 78 can rotate drums 32 to raise or lower upper section 12 at a controlled rate, regardless of whether upper section 12 is carrying the weight of lower section 14.

Figure 12:
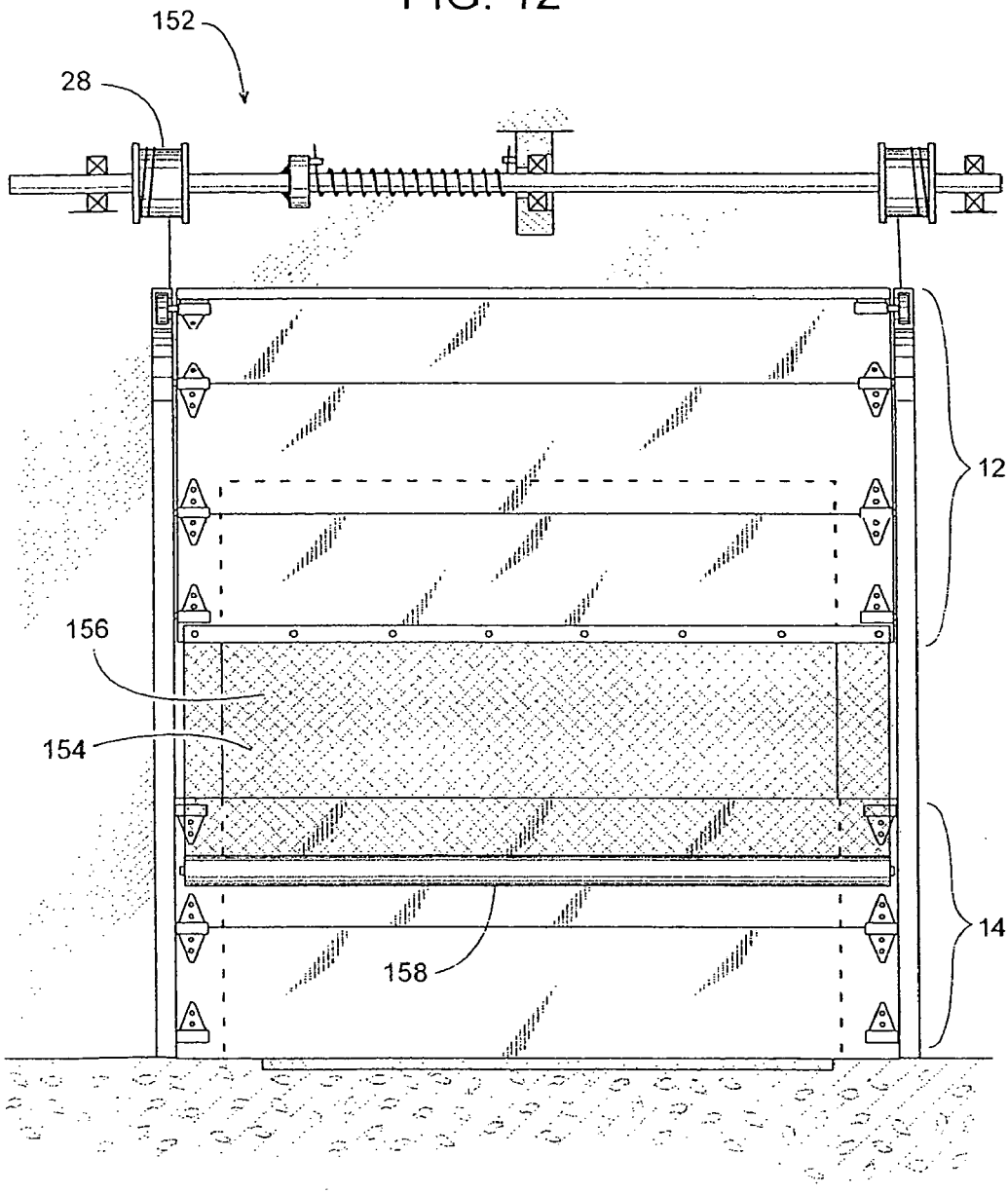
FIG. 12 is a front view of another door embodiment at its barrier position.
Figure 13:
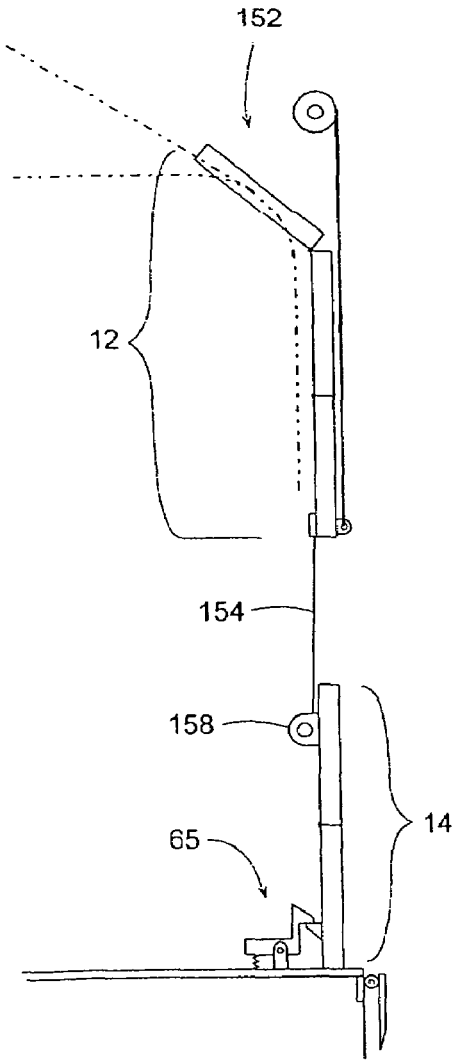
FIG. 13 is a schematic end view of the door of FIG. 12.
Figure 14:
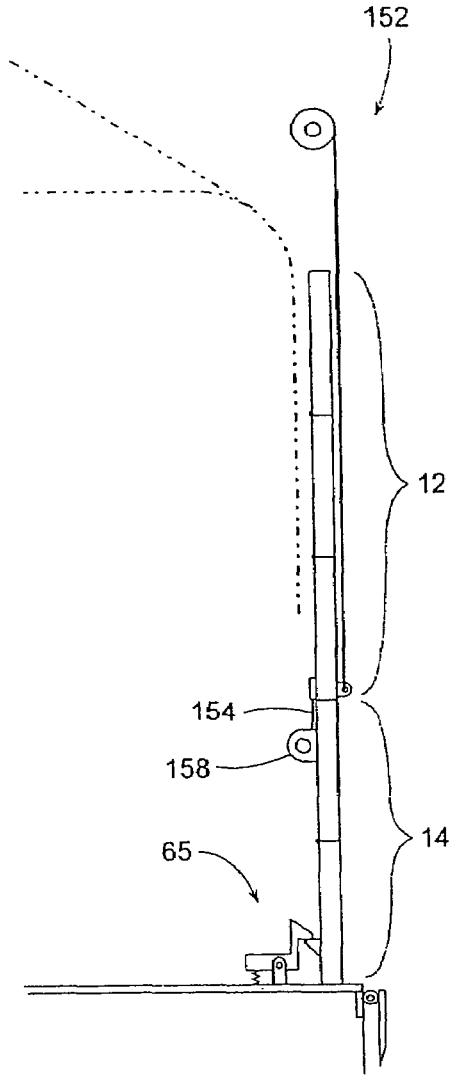
FIG. 14 is a schematic end view similar to FIG. 13 but showing the door in a closed position.

In another embodiment demonstrating weight compensation, shown in FIGS. 12-14, upper section 12 and lower section 14 of a door 152 are coupled by a separation-limiting member 154, wherein member 154 comprises a mesh 156 (or straps, cables, etc.) wrapped around a spring-loaded roll tube 158. A torsion spring in roll tube 158 maintains mesh 156 in tension. The tension pulls downward on upper section 12 with a force comparable to the weight of lower section 14. This helps maintain a more constant load on counterbalance 28 regardless of whether sections 12 and 14 are engaged (FIG. 14) or disengaged (FIGS. 12 and 13). If roll tube 158 creates a tension in mesh 156 that is greater than the weight of lower section 14, then holding device 65 (FIGS. 13 and 14) can be added, and a latch assembly, such as latch 42, is unnecessary.

Figure 15:
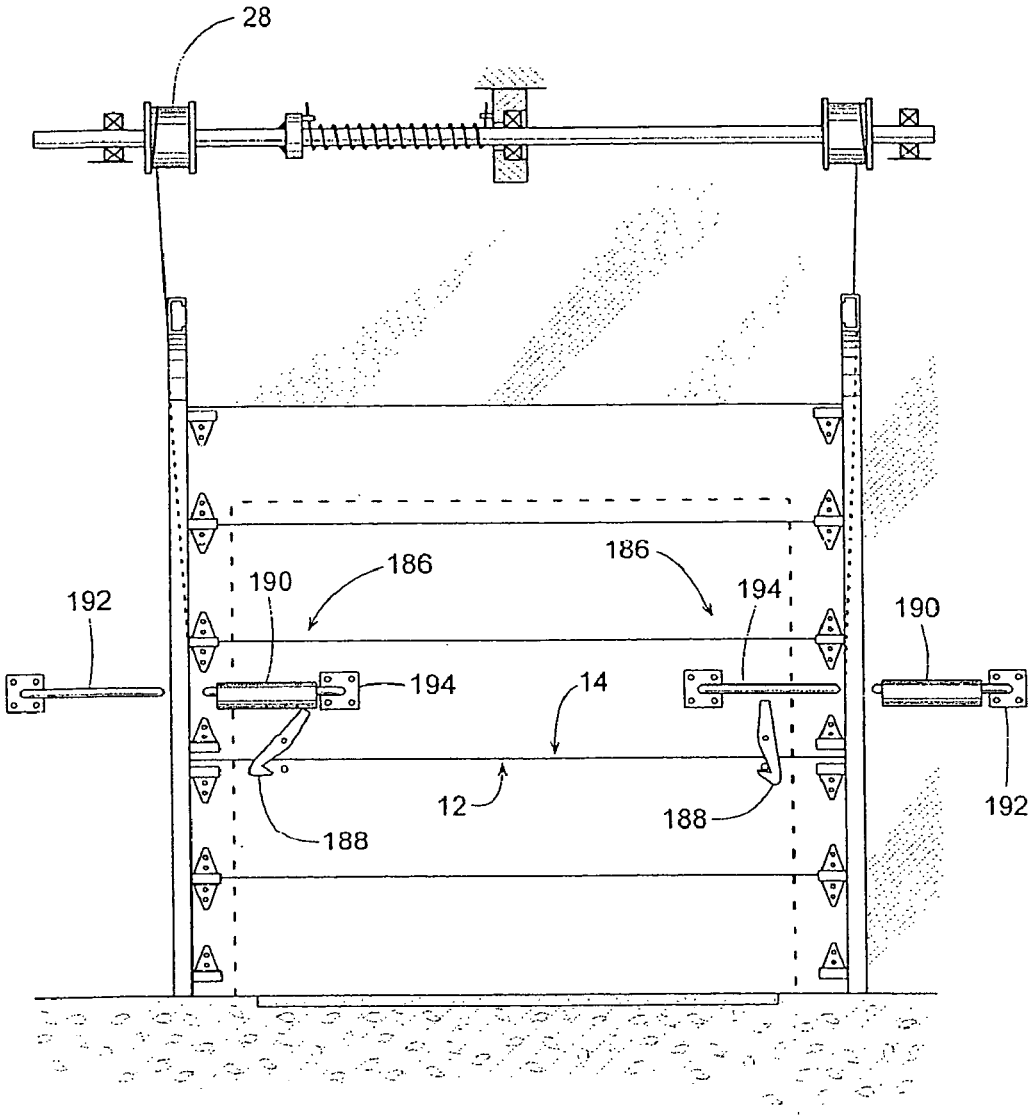
FIG. 15 is a front view of a door with weight transfer system working in conjunction with a latch mechanism.

In another embodiment with structure performing the weight compensation function, shown in FIG. 15, a door 184 includes a weight transfer system 186 that works in conjunction with a latch 188 that separates the upper and lower door sections. System 186 includes a deadweight 190 (e.g., a metal pipe) that can be manually slid between a wall-mounted rack 192 and a door-mounted rack 194. When latch 188 is latched and deadweight 190 is stored on the wall-mounted rack 192, as shown in the right side of the drawing figure, upper and lower door sections 12 and 14 are engaged to open and close as a unit. Counterbalance 28 is set to match the combined weight of door sections 12 and 14, so the door can open and close smoothly and controllably.

To separate sections 12 and 14, deadweight 190 can be slid from wall-mounted rack 192 to door-mounted rack 194, as shown in the left side of FIG. 15. Moving deadweight 190 onto door-mounted rack 194 not only unlatches latch 188, but also beneficially adds weight to the door's upper section 12, whereby the added weight of deadweight 190 compensates for unlatching or releasing the weight of the door's lower section 14 from counterbalance 28. With the combined weight of door sections 12 and 14 being substantially equal to the combined weight of upper section 12 and deadweight 190, the load on counterbalance 28 remains generally constant regardless of whether sections 12 and 14 are engaged or separated.

At certain times (e.g., during bad weather) it may be desirable for the ventilation area to be closed and for the door to be used as a typical sectional door. To close ventilation area 22, sections 12 and 14 are brought together, and a latch or latch assembly 42 keeps them engaged as the door opens and closes. For the embodiment of FIGS. 1-3, latch 42 is a conventional hasp 44 with a removable hairpin 46 that fits through a padlock ring 48. When hasp 44 extends to engage its padlock ring 48, the hasp's hinge pin 50 provides a pivotal connection between sections 12 and 14. The pivotal connection enables sections 12 and 14, which may comprise a plurality of pivotally interconnected door panels, to follow a curved track 52, such as those typically used for vertically moving doors that stow their door panels along a generally horizontal overhead plane.

In some embodiments, track followers 15 (e.g., rollers, tabs, etc.) travel within track 52 to help guide the movement of door 10. Upper track followers 15*a* extending from door section 12 and a lower track followers 15*b* extending from lower door section 14 help guide the translation of sections 12 and 14 respectively For the right side of the door, the upper and lower track followers share the same track, and the same is true for the left side of the door.

It should be noted, however, that the present invention is not limited to vertically moving doors with pivotally interconnected panels that stow horizontally overhead. In the open position, the upper and lower door sections may lie in a generally vertical plane or at some angle between horizontal and vertical, as indicated by angle 54 of FIG. 6. Sections 12 and 14 may each comprise a plurality of interconnected panels, or each may be a single panel. A metal roll-up door whose vertically moving door panel comprises a plurality of pivotally interconnected metal segments is also well within the scope of the invention. The subject invention applies to powered doors, manually operated doors, doors with a counterbalance, and doors without a counterbalance. Additional modifications will now be explained with reference to the schematic drawings of FIGS. 6, 7 and 8, which correspond to FIGS. 1, 2 and 3, respectively.

Figure 9:
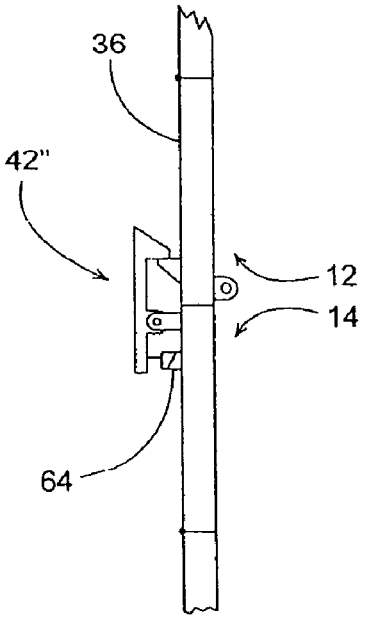
FIG. 9 is a schematic side view similar to FIG. 6 but with portions cutaway and with an electrically rather than a mechanically actuated latch.

In some embodiments, a latch 42' may engage automatically upon the upper and lower sections 12 and 14 coming together. Latch 42', for example, may comprise a spring-loaded pivotal arm 56 that selectively engages a catch member 58. Arm 56 can be attached to lower section 14, and catch member 58 can be attached to upper section 12, or the mounting positions of arm 56 and member 58 can be reversed. Arm 56 and/or catch member 58 has a tapered cam surface that when the arm 56 and catch member 58 come together, the cam surface pushes arm 56 away so that the arm can reach out and over catch member 58 to automatically latch onto member 58. Latch 42' can be disengaged by manually pushing a lower end 60 of arm 56 against the urging of a compression spring 62, or a similar latch 42" can be electrically engaged and/or disengaged by way of an electromechanical actuator, such as a solenoid 64, as shown in FIG. 9. Controlling solenoid 64 can be accomplished through a conventional hardwired control panel or via a wireless transmitter/receiver set.

FIG. 7 shows the flexibility of latch 42' as upper section 12 travels around curved track 52. FIG. 8 shows door 10 in its barrier position where latch 42' is disengaged.

Figure 16:
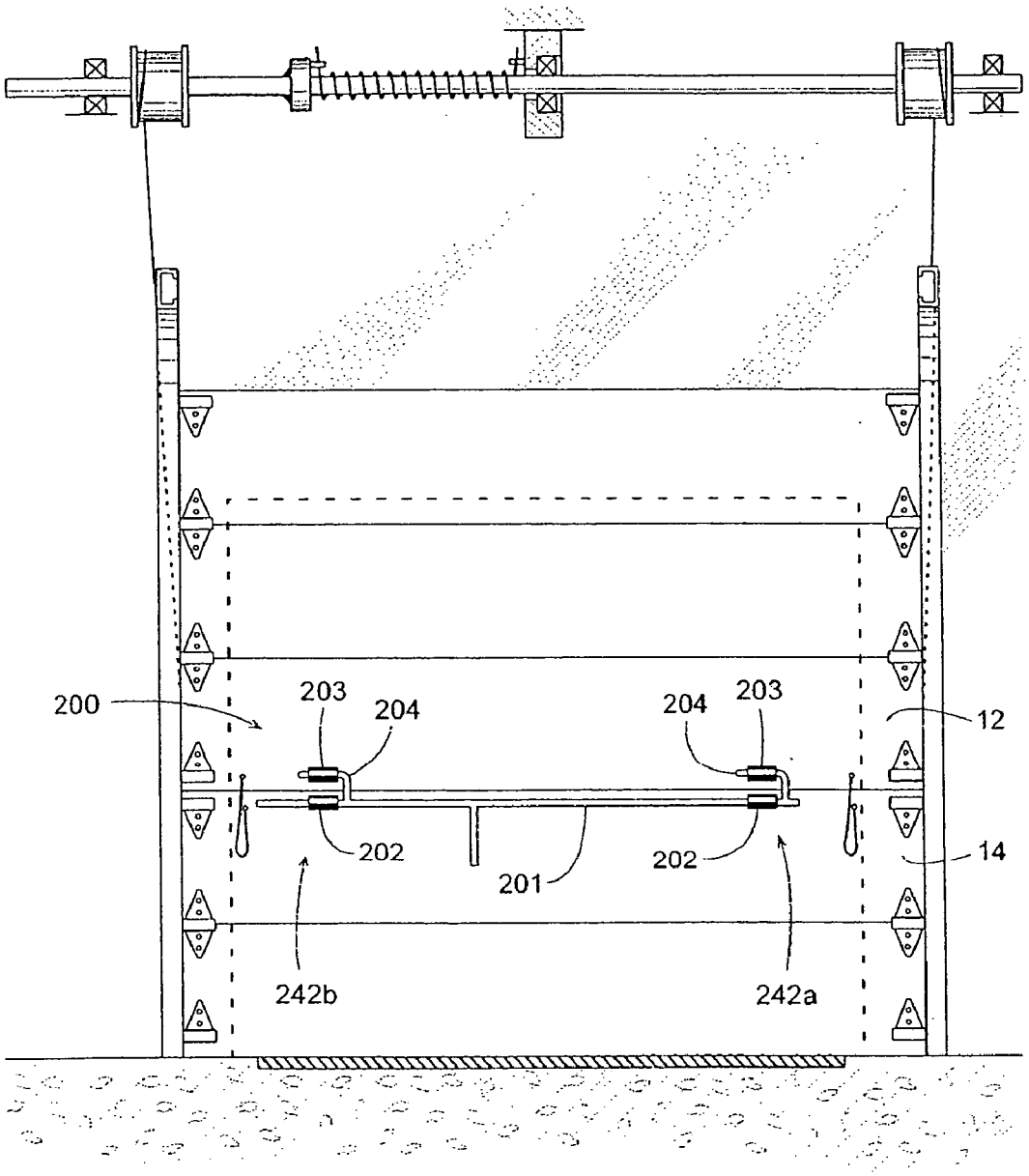
FIG. 16 is a front view of door with a latch mechanism, wherein the latch mechanism is engaged.
Figure 17:
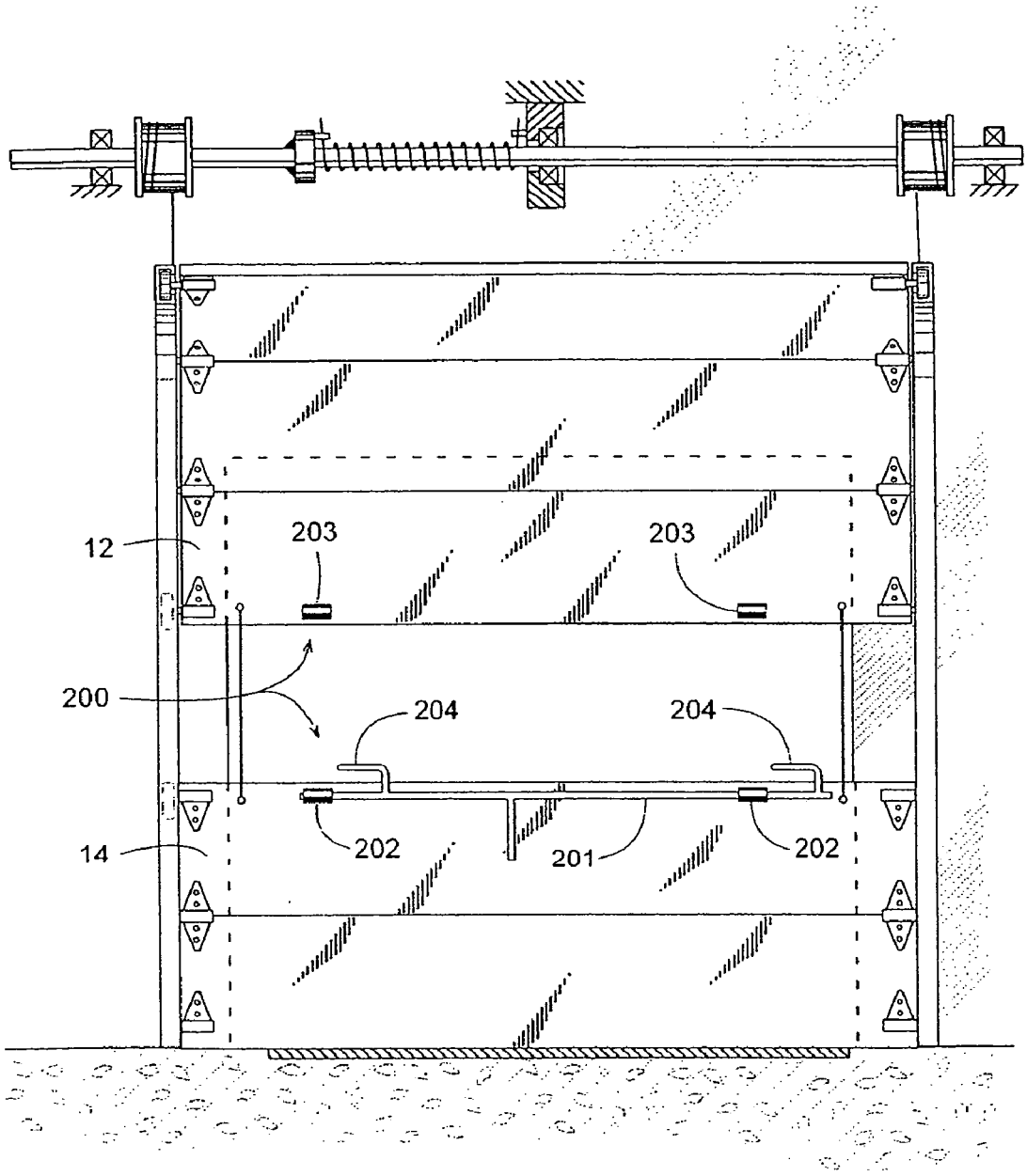
FIG. 17 is a front view similar to FIG. 17 but showing the latch mechanism disengaged.

FIGS. 16 and 17 illustrate a latch mechanism 200 where a right latch 242*a* and a left latch 242*b* can be actuated simultaneously by selectively moving (manually or otherwise) a connecting member 201 to the right or to the left. Connecting member 201 can slide horizontally within two lower tubes 202 that are attached to the door's lower section 14. A similar set of tubes 203 attached to the door's upper section 12 can each receive an L-shaped rod 204 that extends from member 201.

To connect the door's upper section 12 to its lower section 14, as shown in FIG. 16, sections 12 and 14 are brought together, and member 201 is moved to the left so that each rod 204 slides into its respective tube 203. Relative rotation of rod 204 within tube 203 provides a pivotal connection between door sections 12 and 14 so that the door has the flexibility to follow the path of a curved set of tracks as the door opens and closes. To separate sections 12 and 14, as shown in FIG. 17, member 201 is slid to the right to disengage each rod 204 from its corresponding tube 203.

Figure 18:
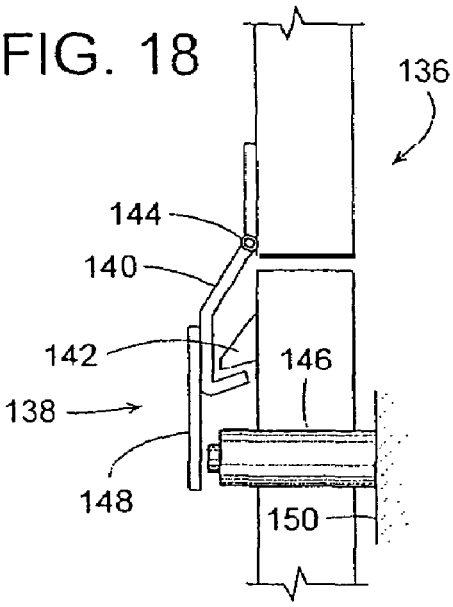
FIG. 18 is an end view showing solenoid-actuated latch in a latched state.
Figure 19:
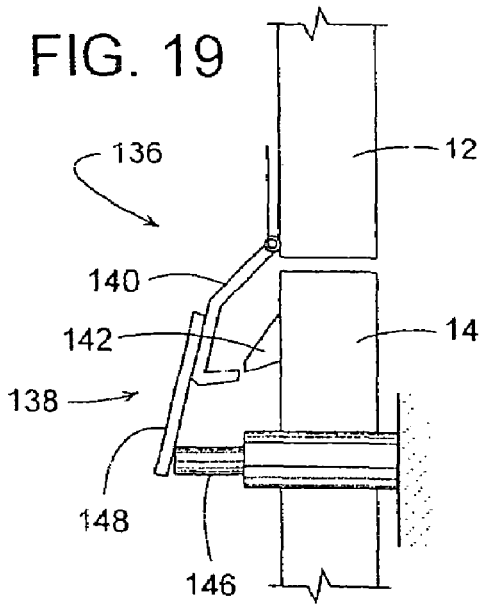
FIG. 19 is an end view similar to FIG. 18 but showing the latch in an unlatched state.
Figure 20:
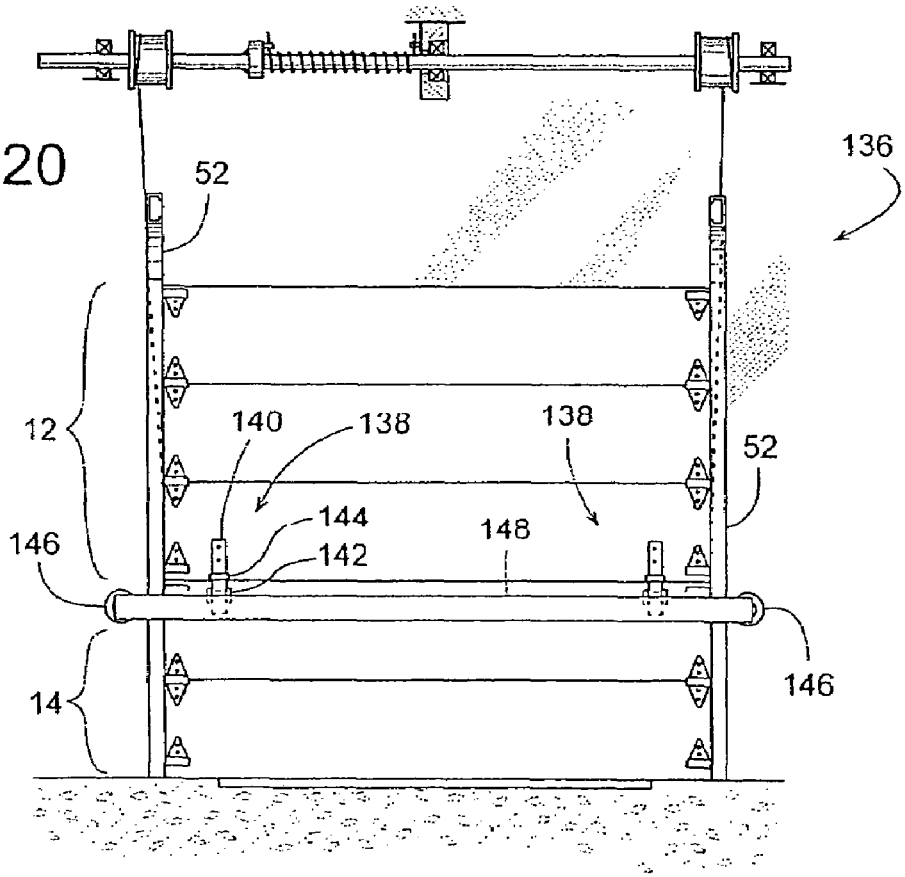
FIG. 20 is a front view of the door of FIG. 18.

Additional embodiments will now be described with reference to FIGS. 18-34. FIGS. 18-20 show a door 136 where upper and lower sections 12 and 14 can be selectively engaged and disengaged by an electrically actuated latch assembly 138. Latch assembly 138 includes a first member 140 attached to upper section 12 and a second member 142 attached to lower section 14. A hinge 144 pivotally enables first member 140 to latch onto a second member 142 that is attached to lower section 14. An electromechanical actuator 146, such as a solenoid, acts upon a connecting bar 148 to move latch assembly 138 between a latched state (FIG. 18) and an unlatched state (FIG. 19).

Connecting bar 148 may advantageously reach beyond the width of the door so that actuator 146 can be installed at a generally fixed location, such as against the wall or track 52. This allows selective energizing of actuator 146 without having to run extra electrical wiring to the moving part of the door. Bar 148 can be connected to two or more latch assemblies, as shown, so that multiple latch assemblies can be actuated simultaneously. Bar 148 or a similar connecting member (e.g., linkage, cable, chain, etc.) can also be applied to various other latch systems including, but not limited to those shown in FIGS. 1-9 and 11. It will be appreciated by those skilled in the art that actuator 146 may be mounted on the door and controlled via a wire (e.g., a coil cord) run to the door or via a wireless control.

Door 10 may also include a holding device 65 that helps hold lower section 14 down when door 10 is at its closed or barrier position. Holding device 65 is similar to latch 42' in that device 65 also comprises a spring-loaded arm 66 that selectively engages a catch member 68, wherein a tapered cam surface is disposed on arm 66 and/or member 68 to enable their automatic engagement with each other.

Figure 21:
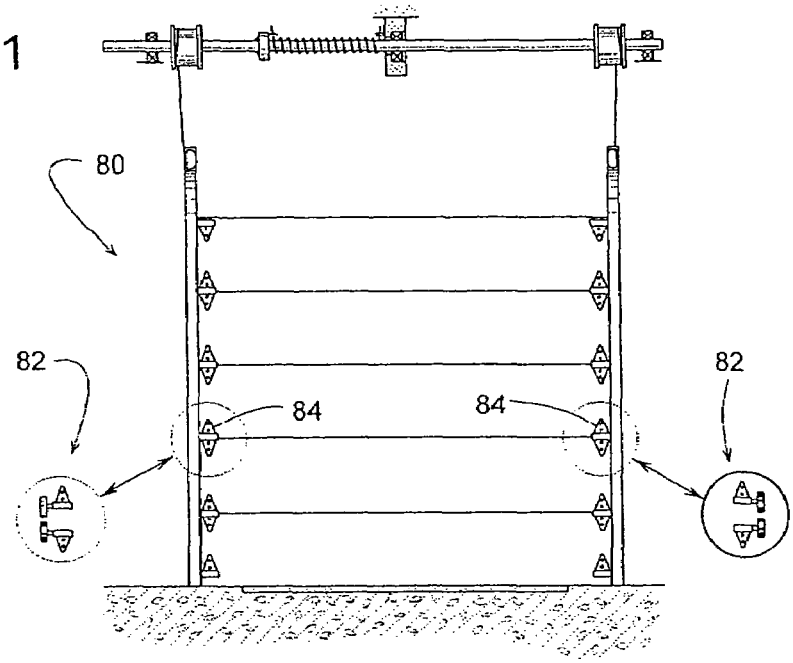
FIG. 21 is a front view showing how an existing door can be retrofitted.
Figure 22:
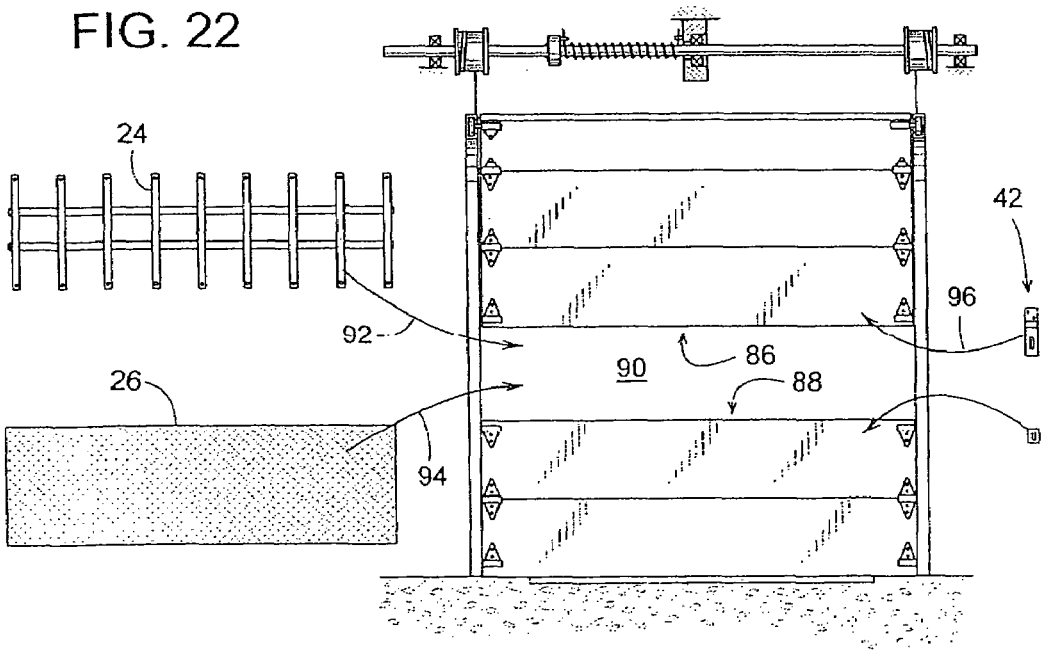
FIG. 22 is a front view showing how an existing door can be retrofitted.

The doors of FIGS. 1-11 can be made as new doors, or they can be the result of retrofitting an existing door 80, as illustrated in FIGS. 21 and 22. A pair of separate roller elements 82, for instance, can replace two conventional roller hinges 84 to create an upper section 86 and a lower section 88. The two sections 86 and 88 can then be disengaged and separated to create a ventilation area 90, the lattice of straps 24 or mesh 26 can be installed between sections 86 and 88, and latch 42 can be attached to the door. The step of installing a plurality of straps is represented by arrow 92, the step of installing a mesh is represented by arrow 94, and the steps of installing a latch and providing for reconnection of sections 12 and 14 are represented by an arrow 96.

Figure 23:
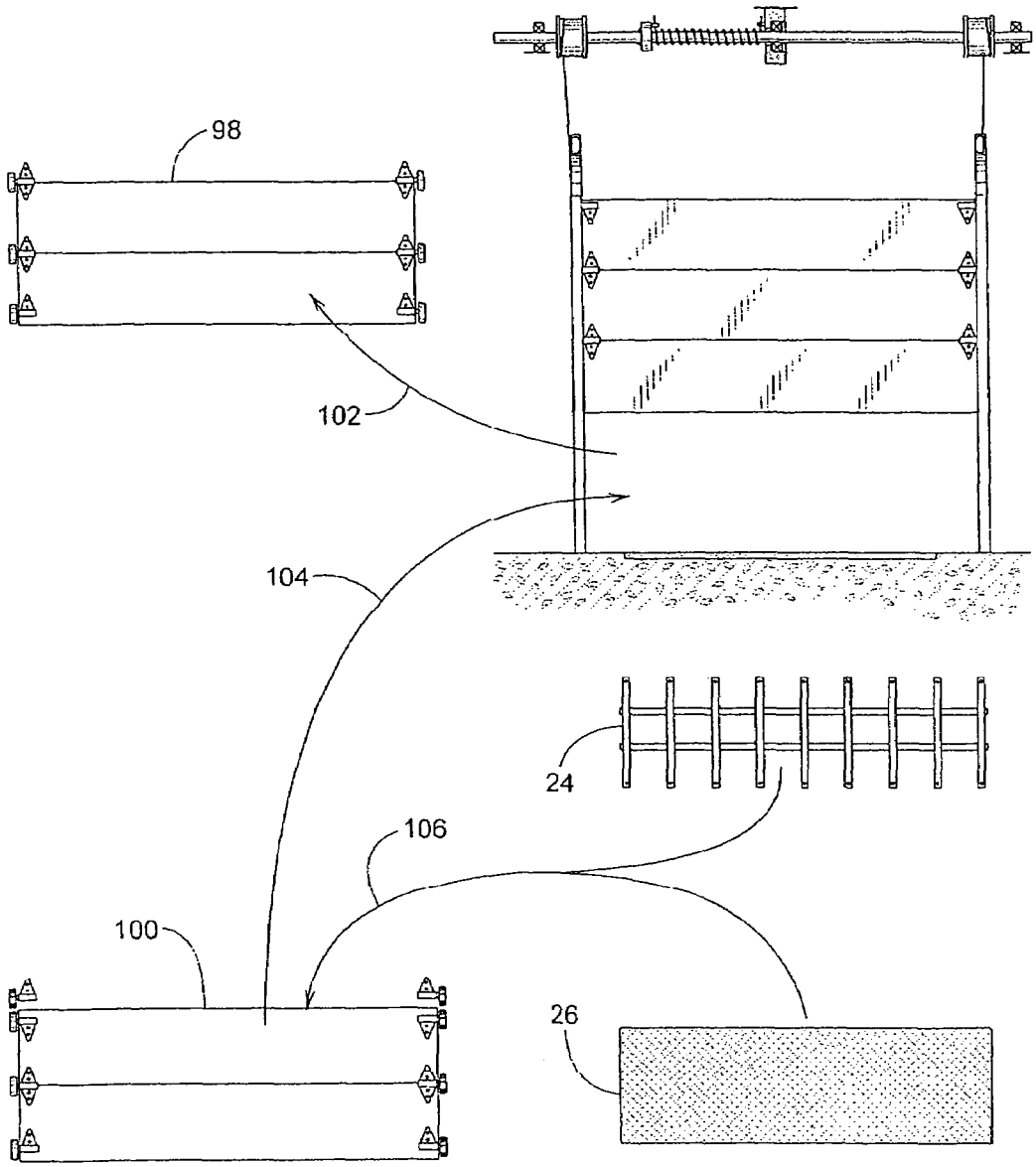
FIG. 23 is a front view showing how an existing door can be retrofitted.

FIG. 23 illustrates another method of retrofitting an existing door by replacing an existing lower section 98 with a new lower section 100, as represented by arrows 102 and 104. In this example, an arrow 106 represents the step of installing straps 24 or installing mesh 26.

Referring to FIGS. 24-34, although a lower section 108 of a door 110 can serve as a safety barrier for runoff protection, a separate, but door-integrated barrier 112 can be installed to help protect lower section 108. Such a barrier is preferably lightweight to ease the opening of the door and should be shock absorbing to minimize the force of an impact. Because the resilient barrier 112 keeps lower section 108 of a door 110 from being impacted, lower section 108, and door 110 in general, can be constructed of lighter, less expensive material. Further, a separate barrier 112 provides the user with the ability to detach it from lower section 108 of door 110 to leave barrier 112 in place while raising the entire door 110. Thus, barrier 112 acts to protect lower section 108, but more importantly, it acts to prevent the runoff of a fork truck and other dock traffic without barrier 112 itself becoming permanently deformed.

Figure 24:
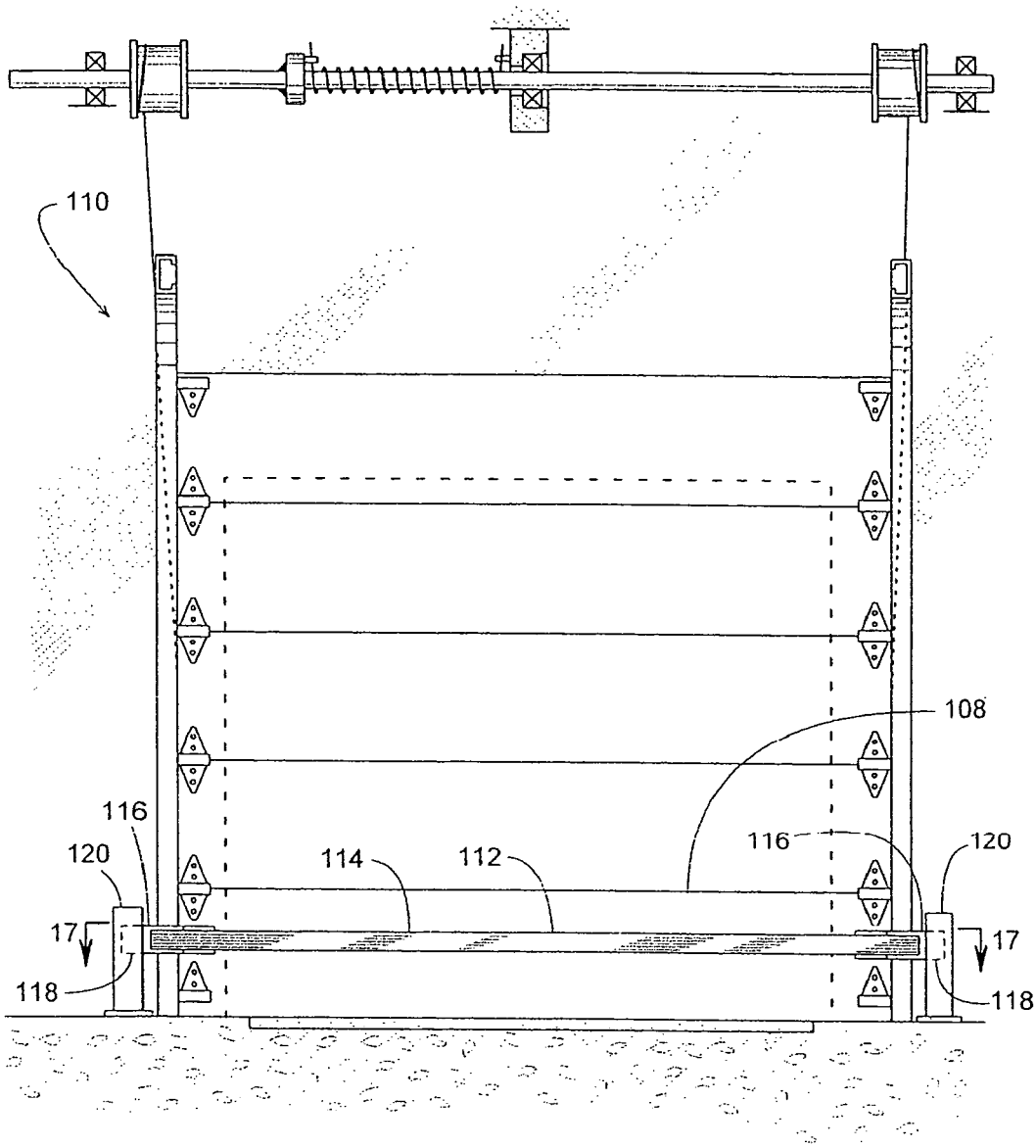
FIG. 24 is a front view of a closed door with a lightweight, resilient barrier.
Figure 25:
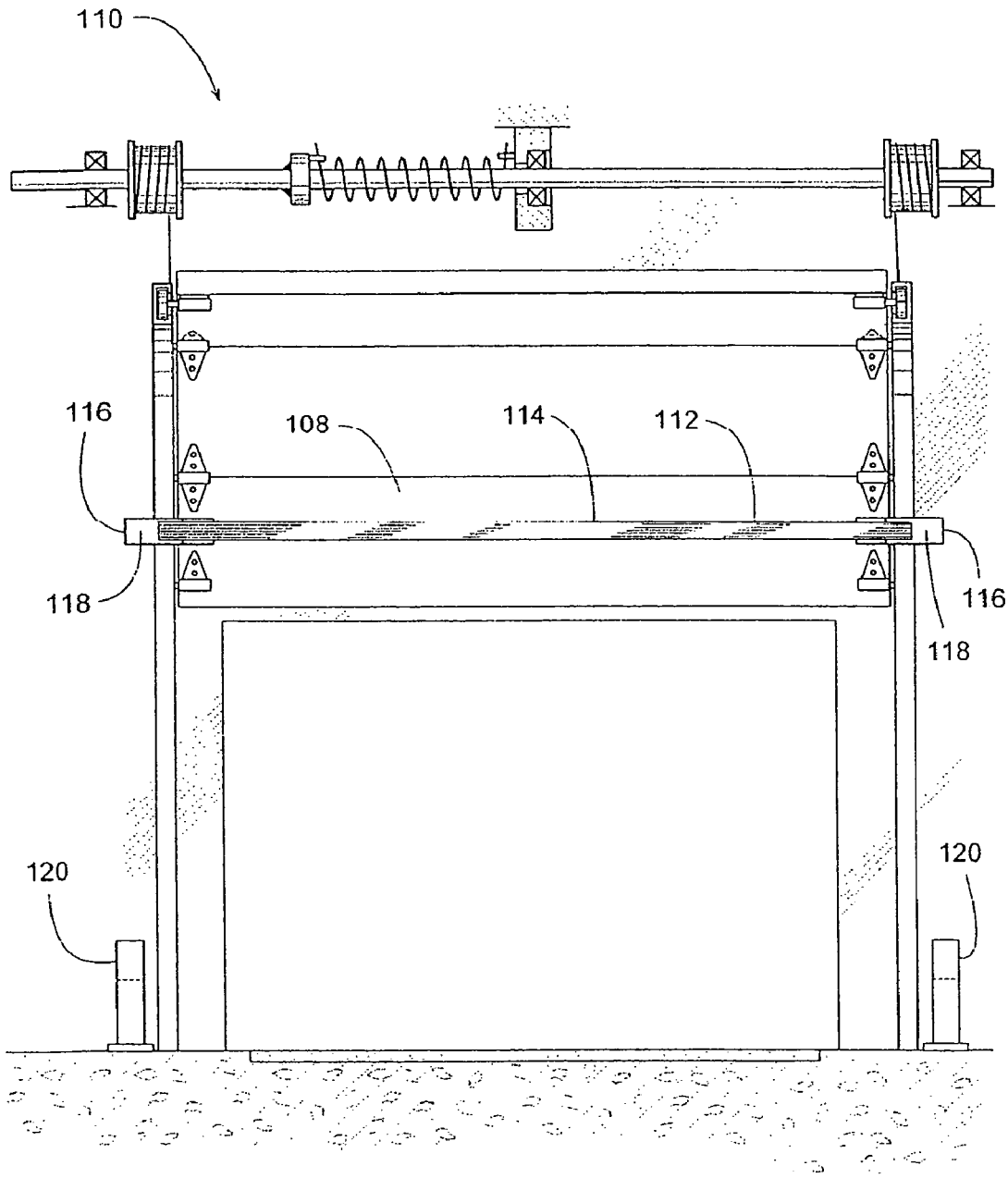
FIG. 25 is a front view similar to FIG. 24 but showing the door open.

To this end, some embodiments of barrier 112 comprise a resilient member 114, such as a nylon strap, bar, cable, chain, etc., that may optionally be held in tension between two opposite ends 116, which in turn are attached to lower section 108. Because barrier 12 is intended to stop a fork truck, an interaction that causes significant (but non-permanent) deformation of resilient member 114, resilient member 114 must be spaced apart from lower section 108 to allow resilient member 114 to yield from the impact, but ultimately stop the fork truck before its wheels reach the end of the leveler or other drop-off point. To reduce forces of impact against lower section 108, each end 116 may comprise a metal bracket 118 that can engage a stationary abutment 120 when door 110 is closed (FIG. 24). The engagement between brackets 118 and abutment 120 can occur automatically by simply closing the door, or the engagement may be the result of an impact forcing bracket 118 into abutment 120. Regardless, brackets 118 can transmit a significant portion of an impact force 122 (FIG. 27), such as from a carelessly driven forklift truck 124, into abutments 120 rather than delivering the entirety of force 122 into lower section 108. Additionally, abutments 120 serve to protect door track 52 against a damaging impact that could cause the door to malfunction (i.e., track 52 could be bent, not allowing door 110 move properly). When door 110 opens (FIG. 25), brackets 118 lift away from abutments 120. In some cases, brackets 118 lift out from within a slot 126 in abutment 120.

Figure 29:
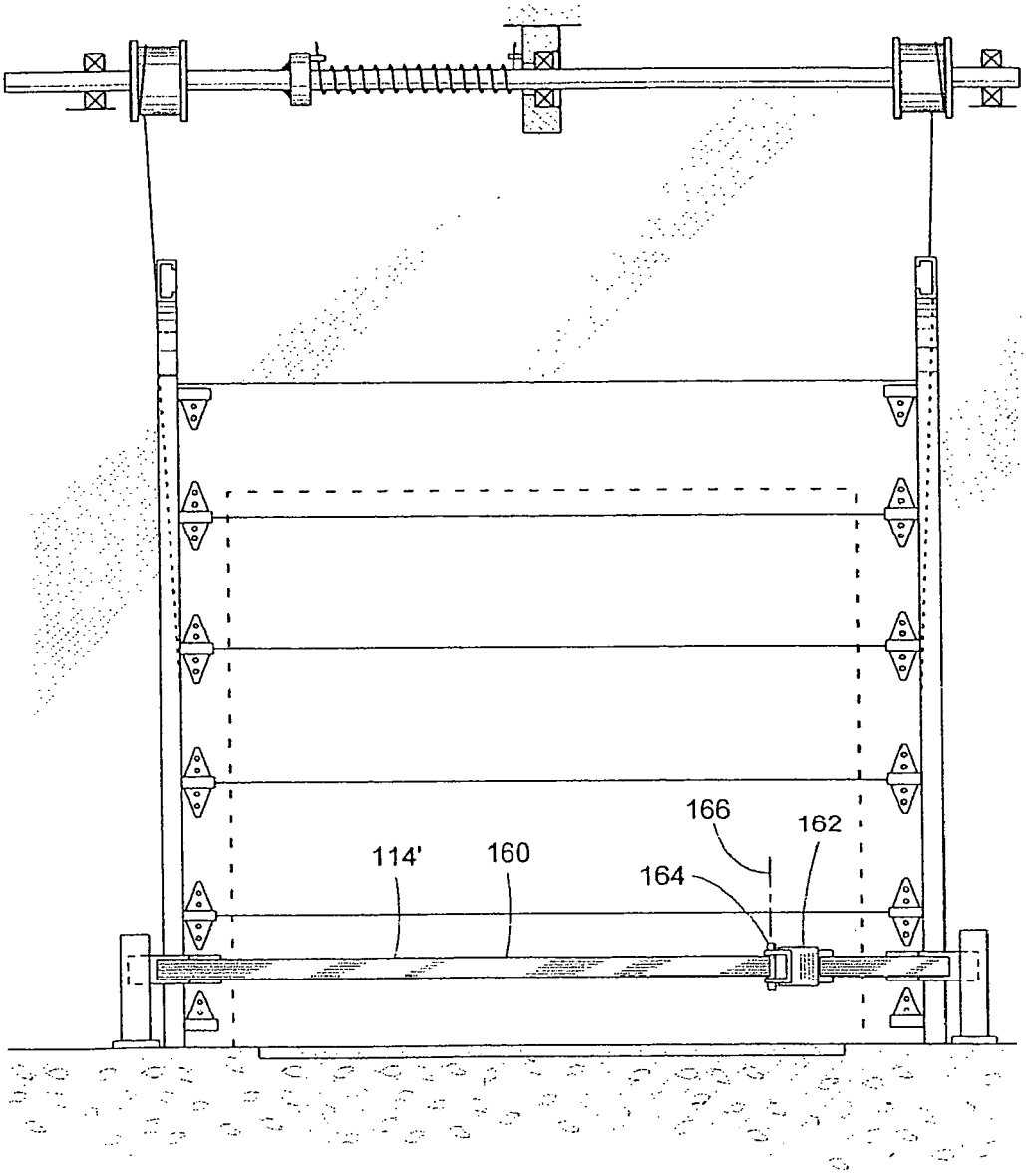
FIG. 29 is a front view similar to FIG. 24 but with a tensioning device added to the strap.

FIG. 29 shows an enhancement of the embodiment shown in FIGS. 24-27. A barrier 160 includes a resilient member 114', such as a strap, which can be tightened by a conventional strap-tightening ratchet device 162. One end of member 114' wraps around a shaft 164 that can be rotated about its longitudinal centerline 166 for tightening member 114'. To prevent creep from reducing the tension in member 114' and diminishing the barrier's effectiveness, ratchet device 162 can periodically retighten and/or reduce the slack in member 114'.

Figure 30:
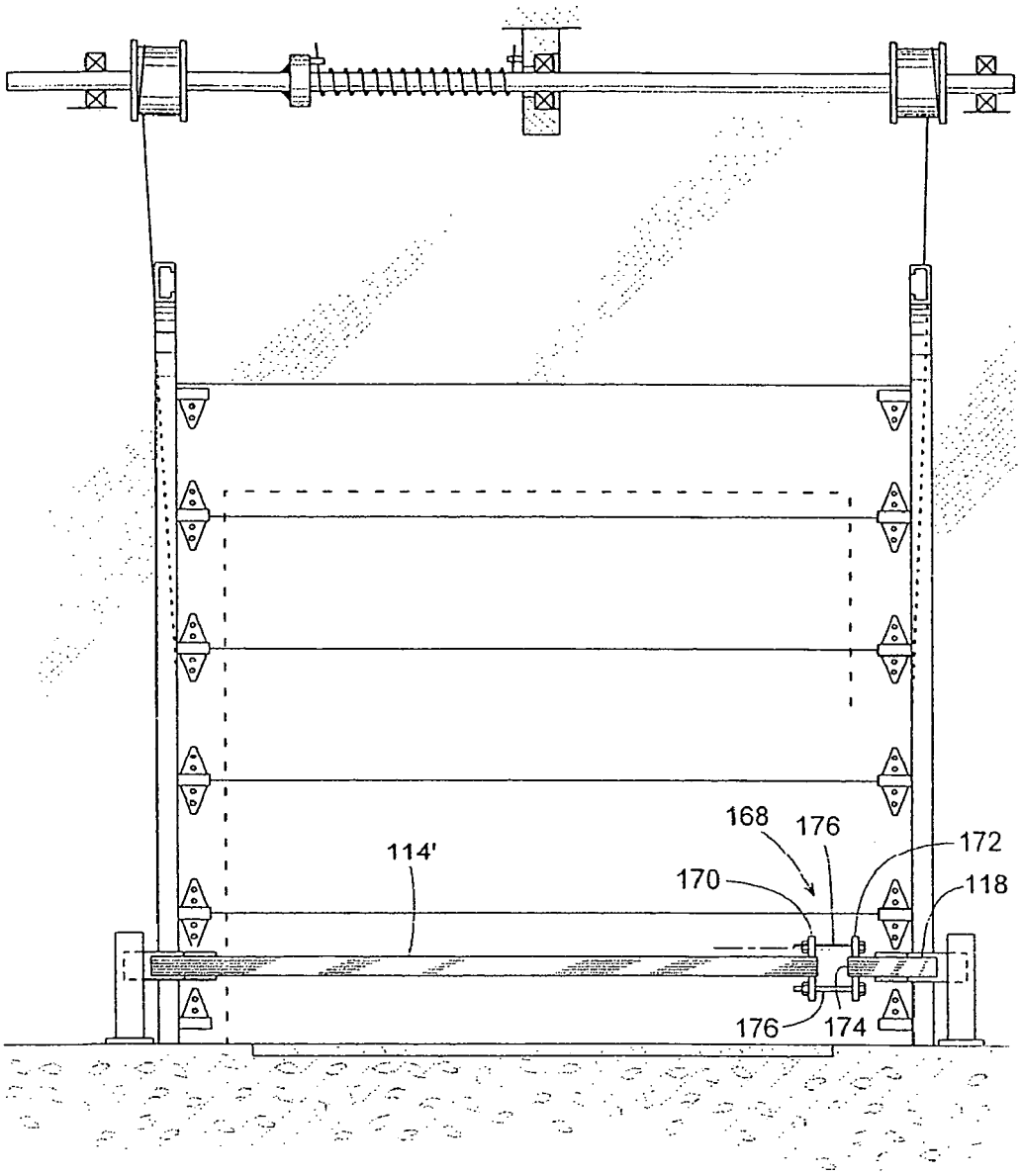
FIG. 30 is a front view similar to FIG. 29 but showing an alternate tensioning device.

In a similar embodiment, shown in FIG. 30, a different tightening device 168 replaces ratchet device 162. Tightening device 168 may comprise two bars 170 and 172 with one bar 170 being coupled to resilient member 114' and the other bar 172 either being connected to a second resilient member 174 or incorporated with bracket 118. One or more threaded shafts 176 (e.g., threaded rod, bolt, screw, etc.) can be tightened by relative rotation between shaft 176 and a mating threaded hole (e.g., a threaded nut or a tapped hole in bar 170). Tightening shafts 176 draw bars 170 and 172 toward each other, which increases the tension in resilient member 114'.

Figure 31:
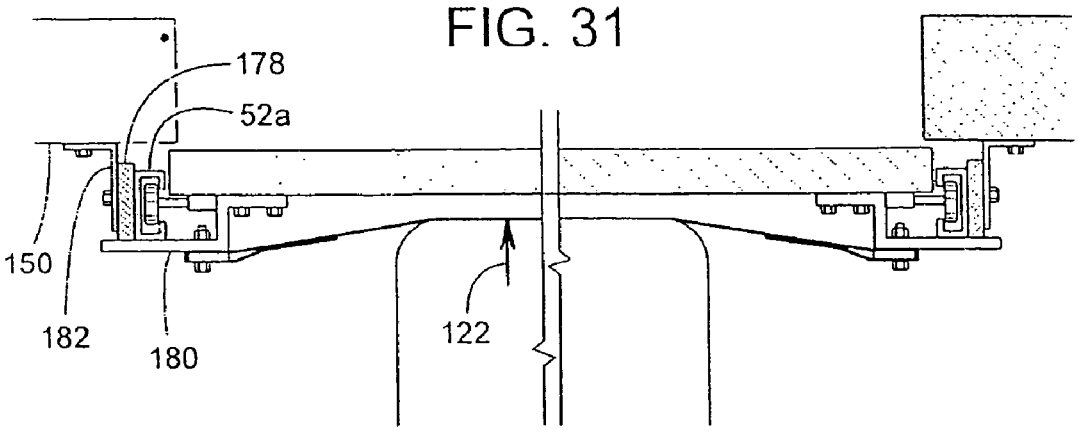
FIG. 31 is a cross-sectional top view similar to FIG. 27 but with the abutment of FIG. 27 replaced by a reinforced section of track.
Figure 32:
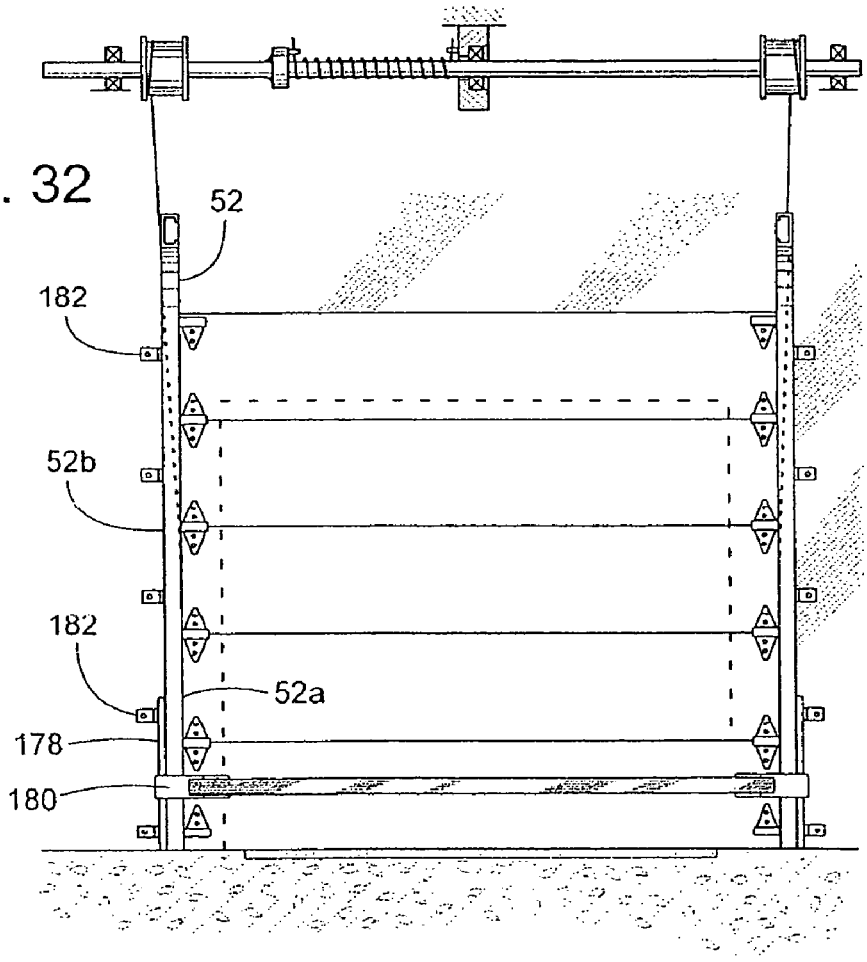
FIG. 32 is a front view of the door of FIG. 31.

The embodiment of FIGS. 31 and 32, is similar to that of FIGS. 24-27; however, abutment 120 is replaced by a lower track section 52*a* that is reinforced by a bar 178. Bracket 180 transmits a force of impact 122 into the reinforced lower track section 52*a*, which now serves as an abutment. To minimize the total cost of track 52, an upper track section 52*b* does not necessarily have to be reinforced. Brackets 182 connect track 52 to wall 150.

Figure 26:
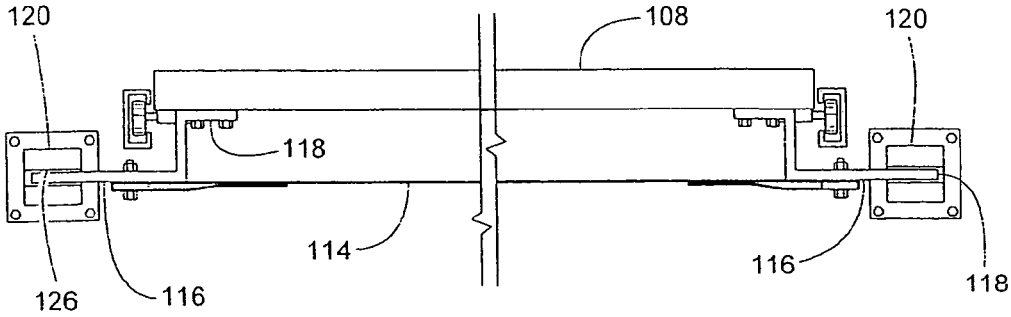
FIG. 26 is a cross-sectional view taken along line 26-26 of FIG. 24.
Figure 27:
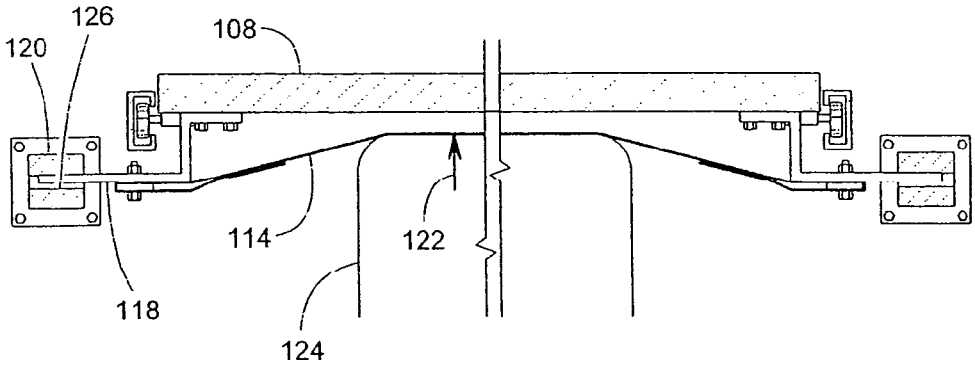
FIG. 27 is a cross-sectional view similar to FIG. 26 but showing the results of the barrier being subjected to a force of impact.
Figure 33:
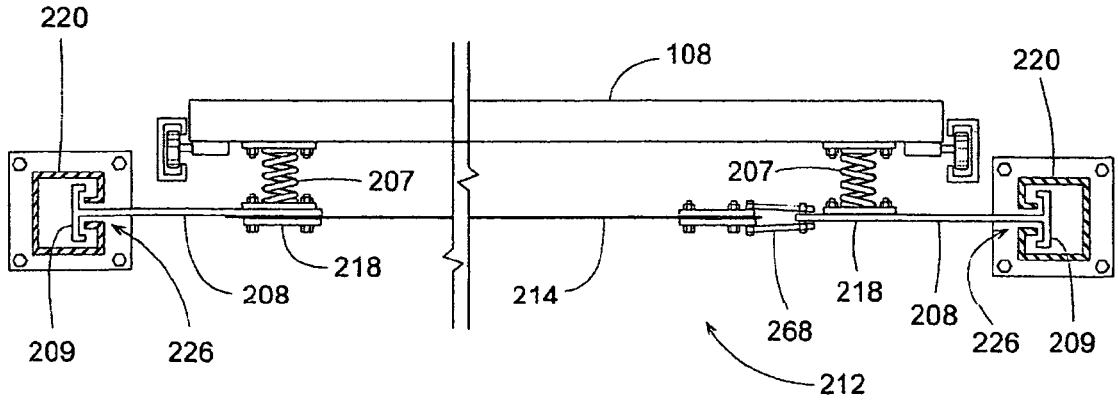
FIG. 33 is a top cross-sectional view similar to FIG. 26 but of another embodiment.
Figure 34:
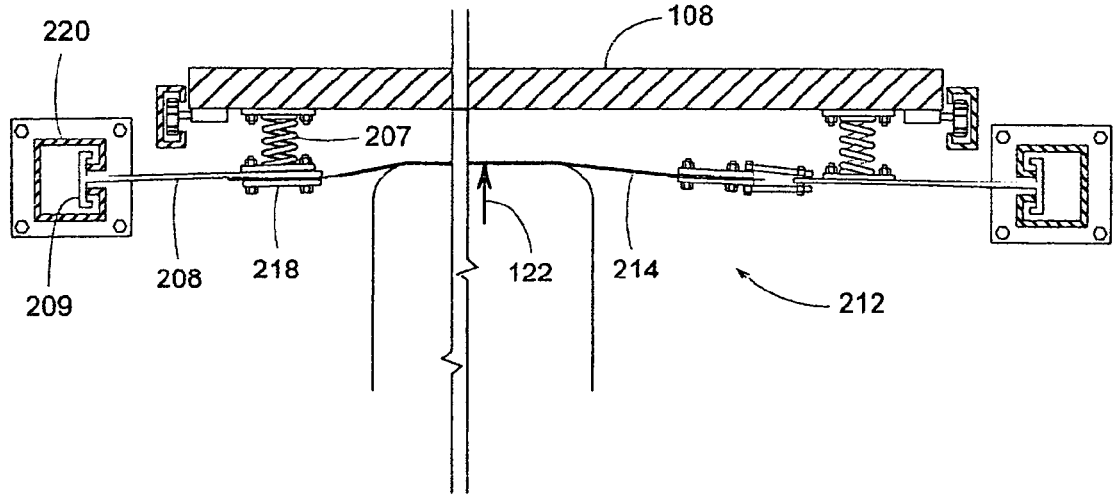
FIG. 34 is a top cross-sectional view similar to FIG. 27 but showing the embodiment of FIG. 33.
Figure 35:
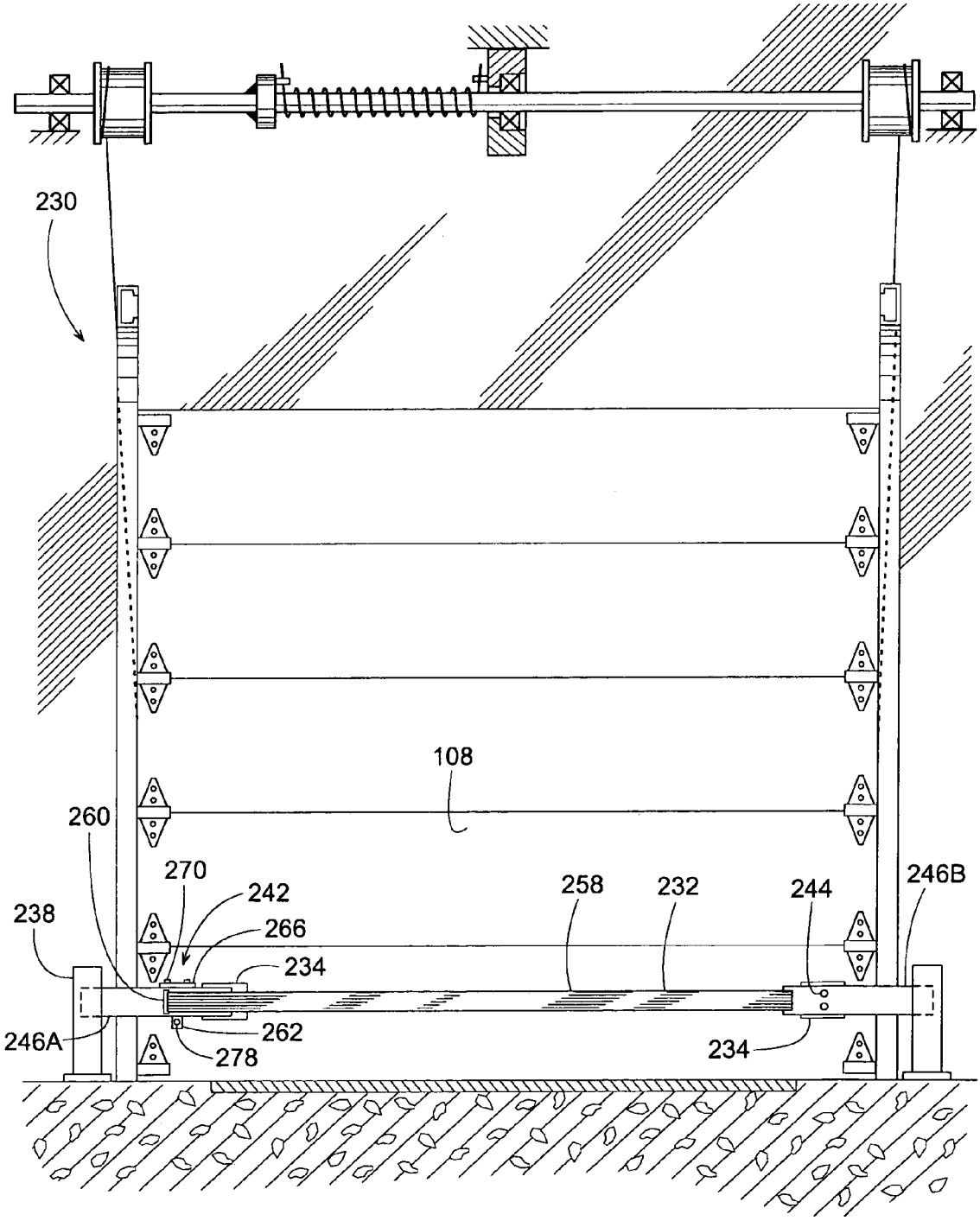
FIG. 35 is a front view similar to FIG. 24 but of another embodiment.

Another embodiment similar to that of FIGS. 24-32 is shown in FIGS. 33 and 34, which correspond to FIGS. 26 and 27, respectively. In this example, a barrier 212 comprises a resilient member 214 held between two brackets 218. A tightening device 268, similar to device 168 of FIG. 30 can adjust the tension in resilient member 214. Each bracket 218 includes an impactable spring 207 for mounting bracket 218 to door panel 108. The resilience of spring 207 helps prevent bracket 218 from being permanently deformed under impact. Bracket 218 also includes a tab 208 that can slip down into a slot 226 of a stationary abutment 220 for transferring impact force 122 into the abutment. Operating the door can move tab 208 in and out of slot 226 in a manner similar to that of bracket 118 and slot 126 of FIG. 26. Tab 208 may include a flange 209 that helps prevent the impact from pulling tab 208 horizontally out from within slot 226. It is desirable to avoid the permanent deformation of bracket 218, because such permanent deformation may prevent tab 208 from properly aligning with slot 226 resulting in a malfunction of the barrier 212.

Figure 28:
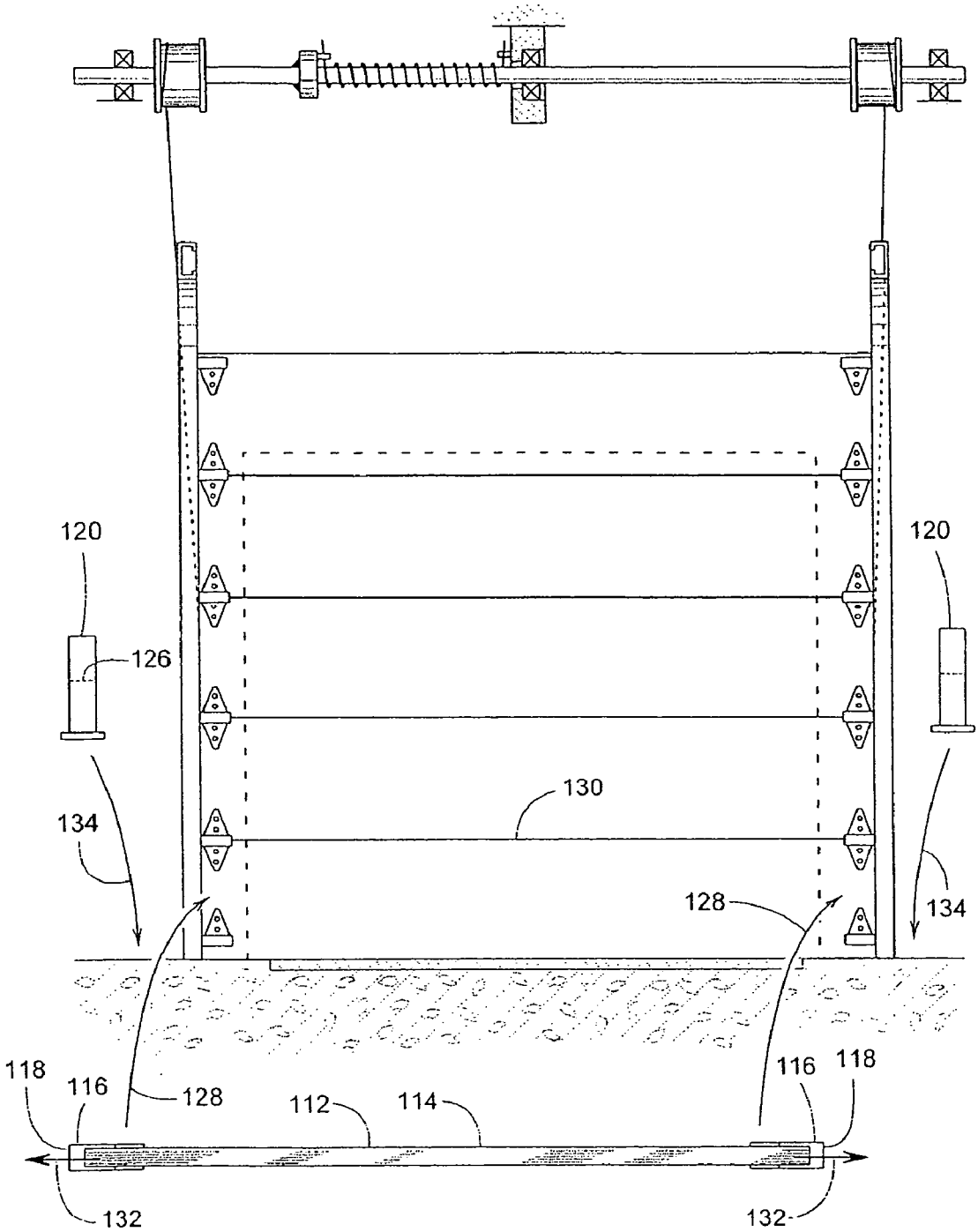
FIG. 28 is a front view showing how a door can be retrofitted with a barrier.

Door 110 can be made as a new door, or it can be the result of retrofitting an existing door, as illustrated in FIG. 28. Arrows 128 represent the step of installing barrier 112 by attaching ends 116 to a door panel 130, arrows 132 represents pulling resilient member 114 in tension, and arrows 134 represent mounting two abutments adjacent an existing door.

In another embodiment, shown in FIGS. 35-44, a door 230 includes a protective barrier 232 that is similar to the barriers shown in FIGS. 24-34; however, barrier 232 includes several additional features such as an adjustable mounting bracket 234, a pinch guard 236 on abutments 238 (FIG. 41), an angled lead-in 240 on abutments 238 (FIG. 41), a unique indexable strap tightener 242, and a shear pin 244 to minimize damage in the event of a severe impact. The purpose of these features and how they can be accomplished will now be described in more detail.

Figure 36:
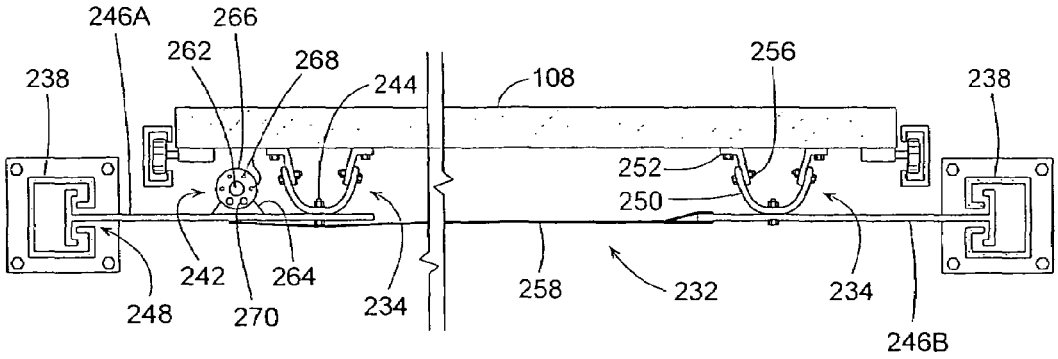
FIG. 36 is a top view of the door of FIG. 35.
Figure 37:
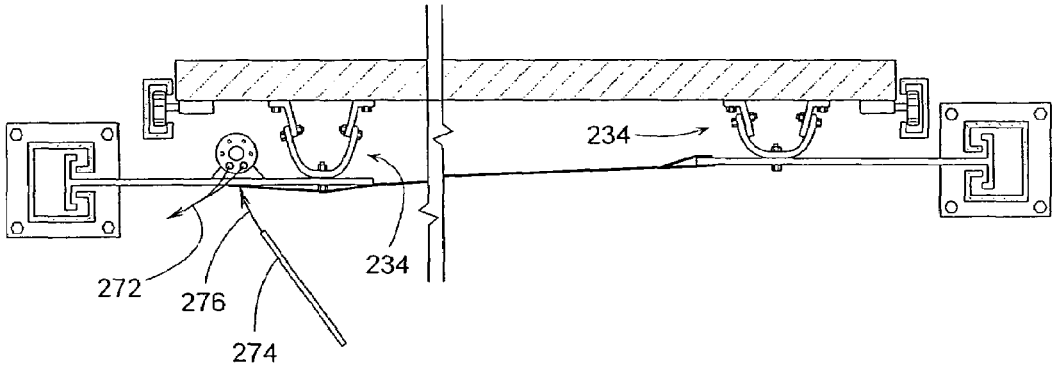
FIG. 37 is a top view similar to FIG. 36 but showing brackets readjusted and the strap about to be adjusted.
Figure 38:
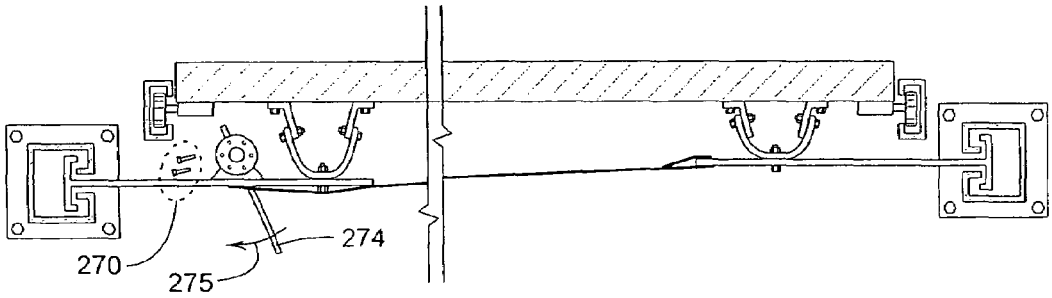
FIG. 38 is a top view similar to FIG. 37 but showing the strap being tightened.

Each adjustable mounting bracket 234 supports a bracket extension piece 246*a* or 246*b* that slides down into a slot 248 of abutment 238 when the door closes. This function is similar to that of the other barriers already described. At least part of mounting bracket 234; however, is preferably made of plastic or some other flexible material to avoid permanent damage on impact. Furthermore, the bracket's adjustability enables the bracket to extend a range of distances from the face of the door, so after abutments 238 are installed, the bracket's adjustment feature allows an installer to align extension pieces 246*a* and 246*b* with slots 248. Comparing FIGS. 36 and 37, for example, both brackets 234 in FIG. 36 are protruding a similar distance from the face of the door; however, in FIG. 37, bracket 234 on the left side of the door is protruding farther out than the one on the right.

Although the adjustment feature can be accomplished in various ways, in some embodiments (FIG. 41) each bracket 234 comprises a plastic or otherwise flexible leaf spring 250 (e.g., flexible band, sheet, bar, etc.) attached to an anchor 252, which in turn is fastened to a door panel 108. Leaf spring 250 and/or anchor 252 has a series of holes 254 through which a fastener 256 can be selectively inserted to achieve the desired spacing between panel 108 and extension pieces 246*a* and 246*b*. As an alternative to holes 254, a leaf spring 250' and/or anchor 252 may include a slot 254' (FIG. 44) for more infinite adjustment.

To adjust the tension in a resilient member 258 (e.g., strap, band, cable, bar, flexible beam, etc.), member 258 can be held in tension between bracket extension 254*b* and strap tightener 242 on bracket extension 246*a*. Resilient member 258 feeds through a slot 260 in extension piece 246*a* and wraps around a rotatable vertical shaft 262 supported by a pair of brackets 264. Brackets 264 are positioned one directly above the other and extend horizontally from bracket extension 246*a*. A round flange 266 affixed to an upper end of shaft 242 includes a series of holes 268 that, with rotation of shaft 262 and flange 266, can be selectively aligned to one or more corresponding holes in upper bracket 264. One or more pins 270 (e.g., screw, bolt, dowel, hitch pin, clevis pin, ball lock pin, etc.) can be inserted through aligned holes in flange 266 and bracket 264 to prevent reverse rotation of shaft 262 and thus prevent the unraveling of member 258 from shaft 262. To tighten member 258, pins 270 are temporarily removed (arrow 272 of FIG. 37) and a lever 274 (pipe, bar, shaft, wrench, handle, etc.) can be inserted (arrow 276) into a hole 278 (FIG. 35) or otherwise engaged with shaft 262. With lever 274 engaged, manual rotation (arrow 275 of FIG. 38) of lever 274 rotates shaft 262 to take up and tighten member 258. Once tightened, pins 270 can be reinserted in the holes of flange 266 and bracket 264, and lever 274 can be removed from shaft 262 and stored.

The impacts that the bottom section of a typical dock door barrier endures during its lifetime can vary greatly in both type and magnitude. One frequent type of impact occurs when the fork extensions at the front of lift trucks and pallet trucks strike the door during the process of lifting, lowering, or placing pallets near the dock door. Another type of impact occurs between the back side of material handling equipment and the door (or protective barrier 232) and has been discussed above and shown in FIGS. 27, 31, 34, 39 and 40. Yet another type of impact occurs when the door is not fully raised and the top portion of material handling equipment strikes lower door section 108, or the door is brought down on top of the material handling equipment. Because impacts can take such a wide variety of forms, protective barrier 232 may not be in a position to prevent door damage in every case. This damage includes deformation of both the specific area of impact and the overall shape and configuration of lower section 108. Therefore, it may still be desirable to have lower door section 108 be impactable, made of a resilient material, because protective barrier 232 may not guard against all types of impact. This would advantageously ensure that lower section 108 is not permanently deformed by such impact and as a result, that extension pieces 246*a* and 246*b* always align with slots 248. If lower section 108 were permanently deformed (i.e., bent or bowed), extension pieces 246*a* and 246*b* may not align with slots 248 or protective barrier 232 may otherwise malfunction. An impactable, resilient lower panel would protect against such malfunction.

Figure 39:
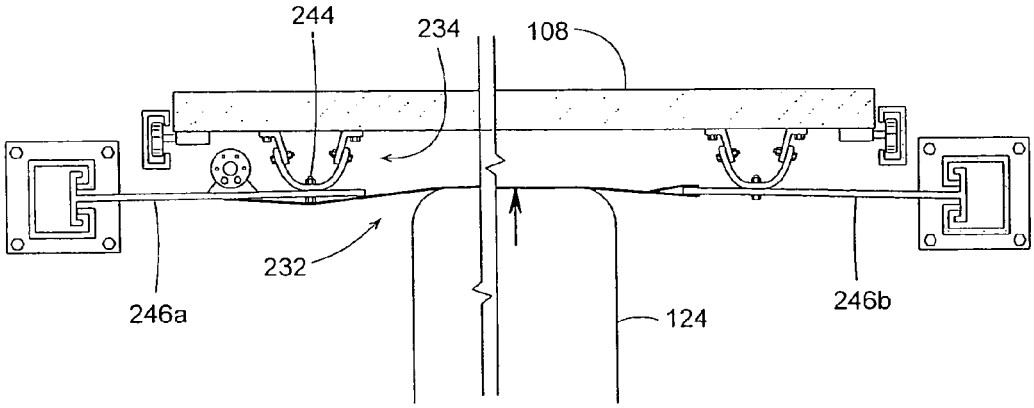
FIG. 39 is a top view similar to FIG. 31 but showing the embodiment of FIG. 35.
Figure 40:
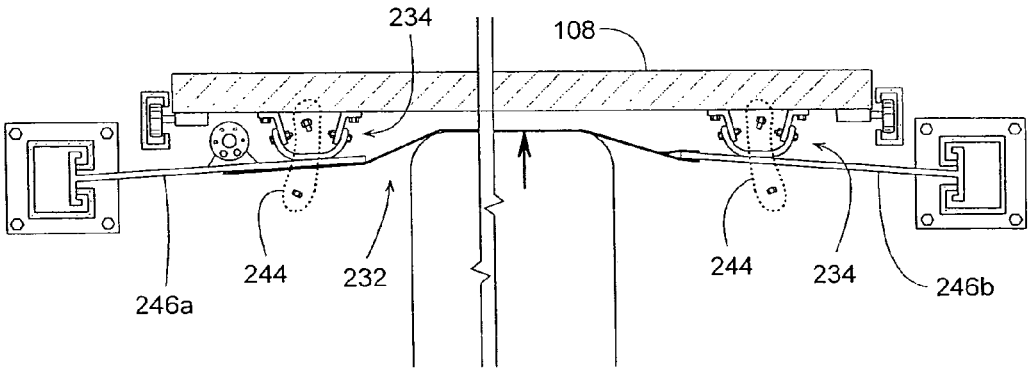
FIG. 40 is a top view similar to FIG. 39 but showing a more severe impact.

FIG. 39 shows barrier 232 reacting to a moderate impact, and FIG. 40 shows barrier 232 responding to a more severe impact. Barrier 232 and brackets 234 can resiliently recover from moderate impacts; however, to prevent costly damage to barrier 232 or brackets 234 under severe impact, shear pins 244 provide readily replaceable, inexpensive breakaway elements that fasten brackets 234 to extension pieces 246*a* and 246*b*. When a substantial impact forces bracket 234 to deform extensively as shown in FIG. 40, the resulting breakage of shear pins 244 allow relative translation between resilient member 258 and brackets 234. This relative motion helps reduce some of the impact force that might otherwise be transmitted to panel 108 or brackets 234.

To ensure that extension pieces 246*a* and 246*b* of barrier 232 slide into slots 248 of abutments 238 as the door closes, the angled lead-ins 240 help guide extension pieces 246*a* and 246*b* into slots 248. This lead-in feature is particularly effective due to the flexibility provided by brackets 234.

Figure 41:
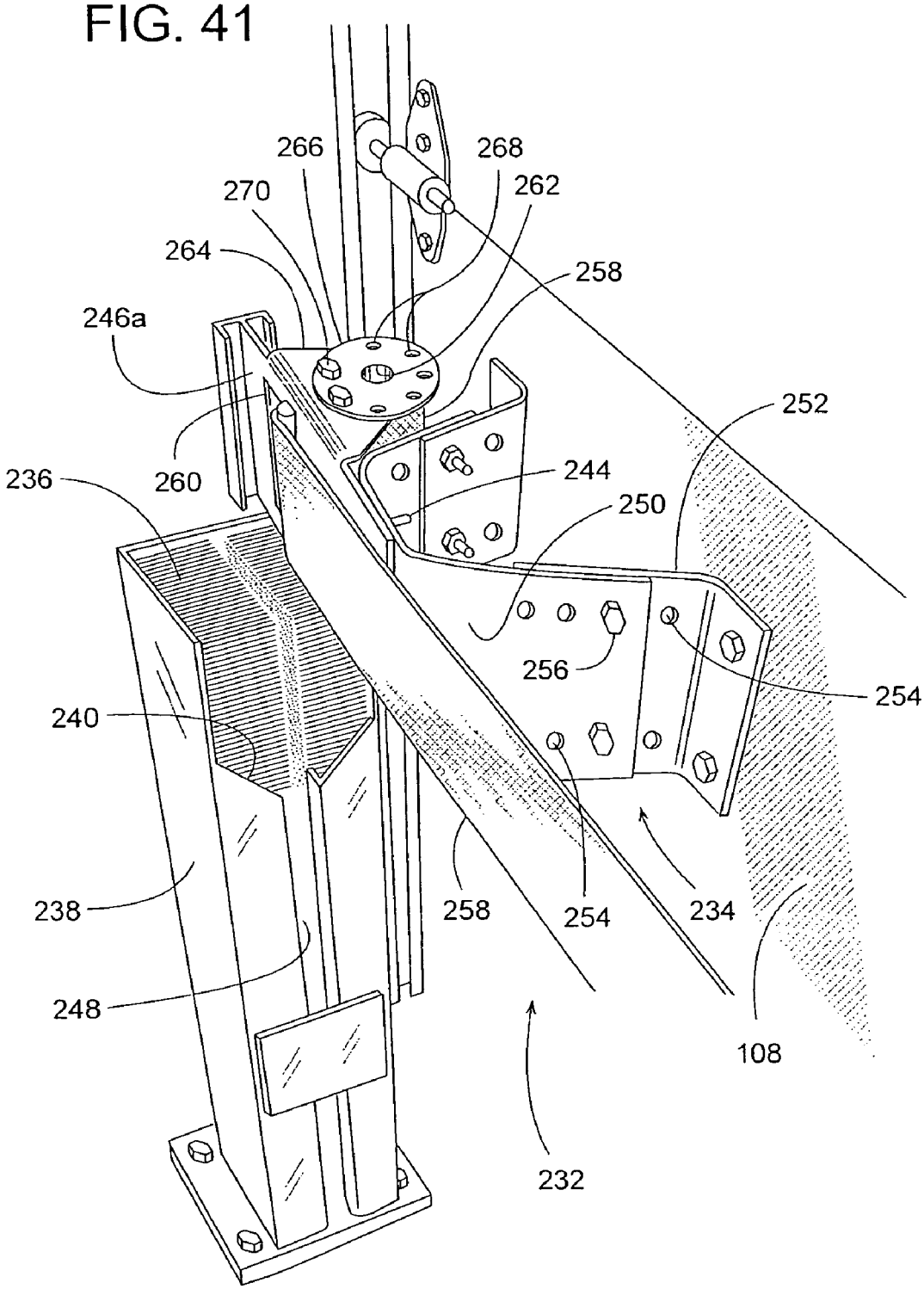
FIG. 41 is a perspective view of a barrier being lowered toward an abutment.
Figure 42:
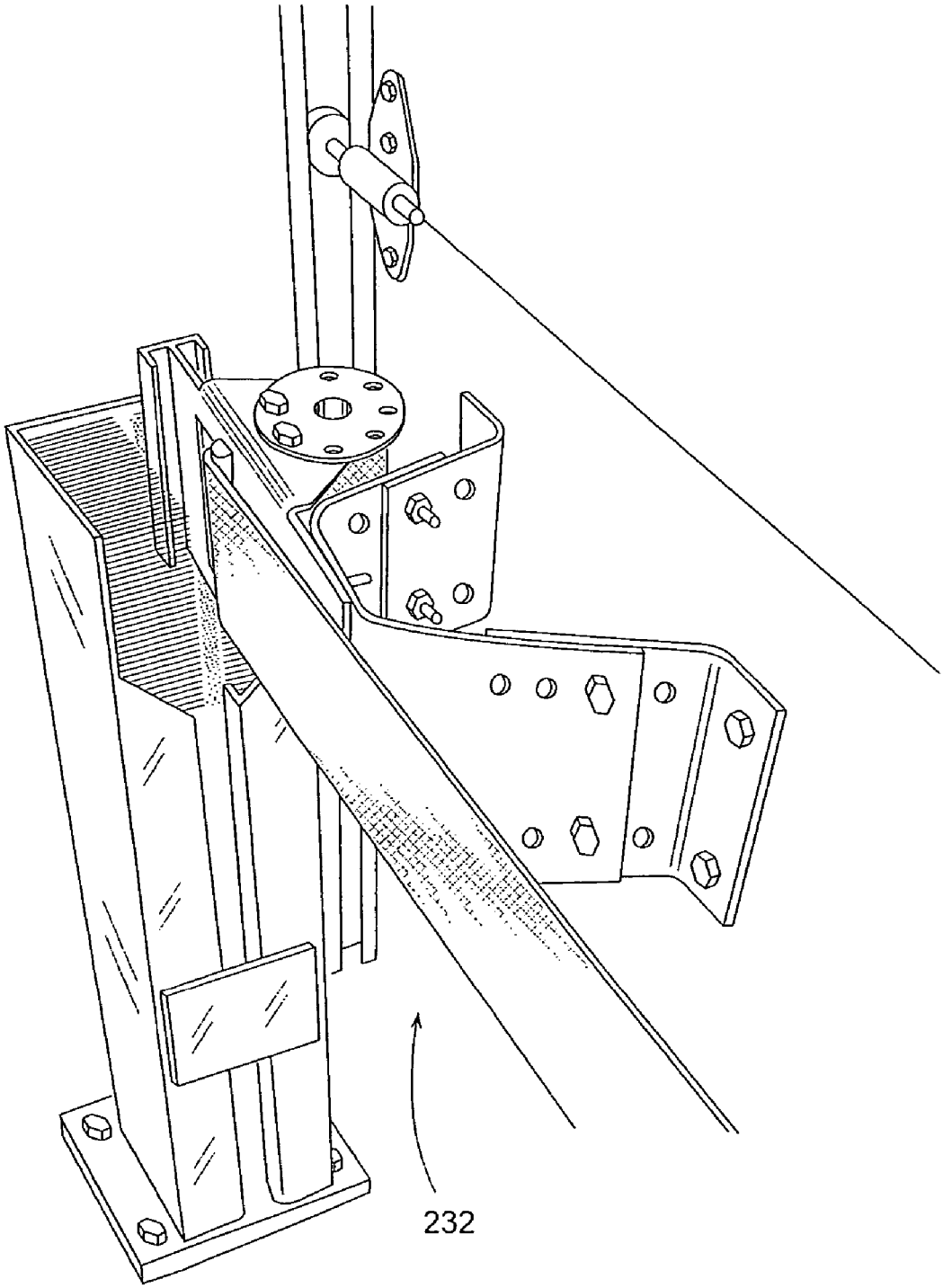
FIG. 42 is a perspective view of a barrier entering an abutment.
Figure 43:
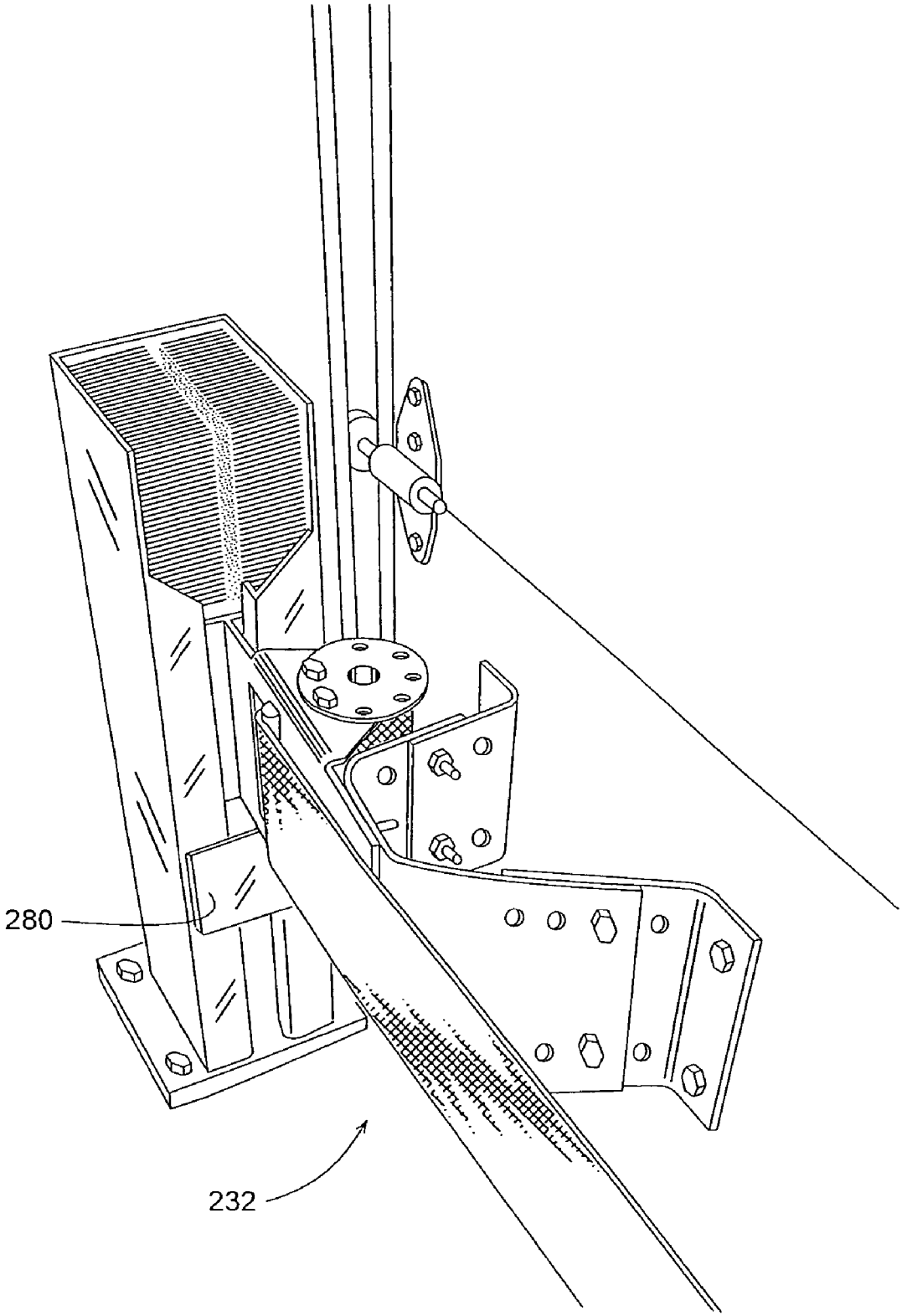
FIG. 43 is a perspective view of the barrier in its fully lowered position.
Figure 44:
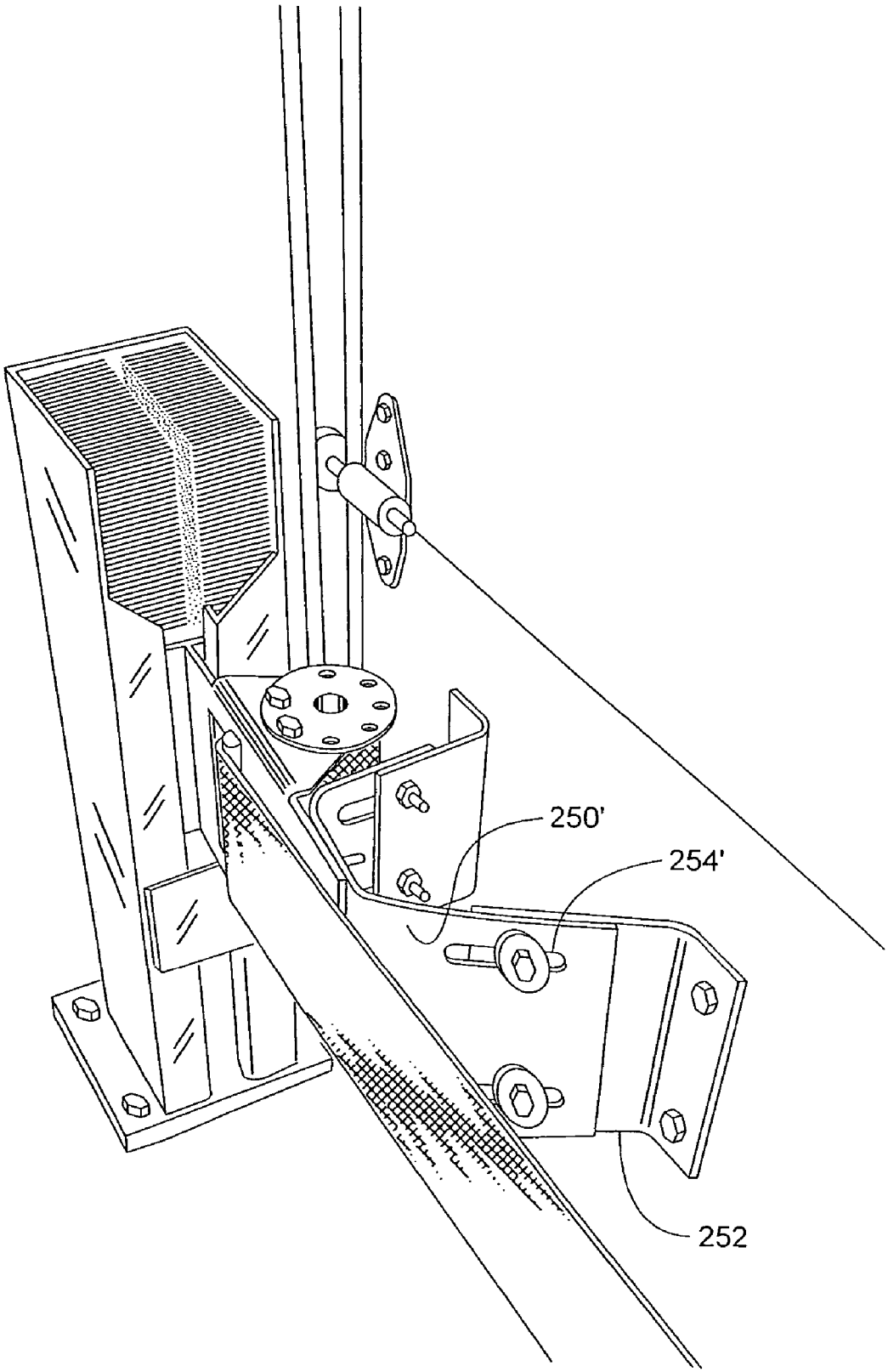
FIG. 44 is a perspective view similar to FIG. 43 but of an alternate embodiment.

Referring to FIG. 41, as door 230 closes, to help prevent a hand or finger from getting accidentally pinched between abutment 238 and extension pieces 246*a* or 246*b*, pinch guard 236 is installed in the area where pieces 246*a* and 246*b* enter slot 248. Pinch guard 236 includes brush-like bristles or some other flexible member (e.g., foam pad, rubber gasket material, etc.) that hinders the insertion of someone's hand or finger yet permits the entry of extension pieces 246*a* and 246*b* into slot 248. FIGS. 41, 42 and 43 illustrate the sequence of extension piece 246*a* coming into engagement with abutment 238, wherein piece 246*a* is approaching pinch guard 236 in FIG. 41, passing through guard 236 in FIG. 42, and coming to rest against or slightly above a bottom stop 280 of abutment 238 in FIG. 43.

Although the invention is described with reference to preferred embodiments, it should be appreciated by those of ordinary skill in the art that various modifications are well within the scope of the invention. Therefore, the scope of the invention is to be determined by reference to the following claims:

What is claimed is:

1. A barrier system able to withstand an impact, the barrier system comprising:

a first abutment defining a slot;

a second abutment laterally spaced apart from the first abutment such that a horizontal gap exists between the first abutment and the second abutment;

a movable structure disposed adjacent to the first and second abutments and movable relative thereto;

a barrier attached to the movable structure for movement therewith between blocking and unblocking positions relative to the first and second abutments, the barrier comprising:

a first bracket for engaging the first abutment, wherein the first bracket includes a flange that cooperates with the slot to react forces applied to the barrier;

a second bracket for engaging the second abutment to react forces applied to the barrier; and a length-adjustable resilient member extending between the first and second brackets.

2. The barrier system of claim 1, wherein the movable structure is a door panel vertically movable between an open and a closed position relative to the doorway.

3. The barrier system of claim 1, further comprising a tightening device for adjusting the tension on the resilient member.

4. The barrier system of claim 3, wherein the resilient member is spaced from the movable structure by a first distance, and wherein the tightening device can adjust the tension on the resilient member while maintaining the first distance fixed.

5. The barrier system of claim 3, wherein the tightening device includes a shaft coupled to the resilient member, such that rotating the shaft about a longitudinal centerline of the shaft adjusts the tension in the resilient member.

6. The barrier system of claim 1, wherein the resilient member has a width spanning substantially the entire lateral space between the first and second abutments, and the brackets include generally planar extensions disposed beyond the width of the resilient member.

7. The barrier system of claim 1, wherein the resilient member is a strap.

8. The barrier system of claim 1, wherein the barrier is attached to the movable structure with a resilient mounting bracket.

9. The barrier system of claim 1, wherein the length-adjustable resilient member is held in tension between the brackets.

10. A door adjacent a doorway and being able to withstand an impact, the door comprising:

a door panel vertically movable between a closed position and an open position;

a first bracket and a second bracket attached to the door panel;

a barrier supported by the first bracket and the second bracket at a spaced-apart distance from the door panel, wherein the barrier extends between the first bracket and the second bracket to receive the impact;

a first abutment defining a first slot and a second abutment defining a second slot, the first and second abutments being mountable at a substantially fixed location adjacent to the doorway such that the barrier disengages the first slot and the second slot when the door is open, and the barrier engages the first slot and the second slot when the door is closed, wherein the first abutment and the second abutment provide added support to the barrier when the door is closed and the barrier is impacted; and an adjustment feature associated with the first bracket and the second bracket to accommodate the spaced-apart distance between the door panel and the first and second brackets.

11. The door of claim 10, wherein the first bracket comprises an anchor and a leaf spring connected to each other.

12. The door of claim 11, wherein the adjustment feature is provided by a third slot defined by at least one of the leaf spring or the anchor.

13. The door of claim 11, wherein the adjustment feature is provided by a plurality of holes defined by at least one of the leaf spring and the anchor.

14. The door of claim 9, wherein the first abutment includes an angled lead-in that at least partially guides the barrier into a proper engagement with the first slot as the door closes.

15. The door of claim 10, wherein the first bracket includes a flange that engages the first slot when the door is closed.

16. A door adjacent a doorway and being able to withstand an impact, the door comprising:

a door panel vertically movable between a closed position and an open position;

a first bracket and a second bracket attached to the door panel;

a barrier supported by the first bracket and the second bracket at a spaced-apart distance from the door panel, wherein the barrier extends between the first bracket and the second bracket to receive the impact;

a first abutment and a second abutment mountable at a substantially fixed location adjacent to the doorway such that the barrier disengages the first abutment and the second abutment when the door is open, and the barrier engages the first abutment and the second abutment when the door is closed, wherein the first abutment and the second abutment provide added support to the barrier when the door is closed and the barrier is impacted; and a pinch guard disposed at an upper end of the first abutment, wherein the pinch guard is yieldable to reduce a pinching hazard that may exist between the barrier and the first abutment as the door closes.

17. The door of claim 16, wherein the pinch guard includes a plurality of flexible bristles.

18. The door of claim 16, wherein the first abutment defines a slot that is engaged by the barrier when the door is closed.

19. A door adjacent a doorway and being able to withstand an impact, the door comprising:

a door panel vertically movable between a closed position and an open position;

a first bracket and a second bracket attached to the door panel;

a barrier supported by the first bracket and the second bracket at a spaced-apart distance from the door panel, wherein the barrier extends between the first bracket and the second bracket to receive the impact;

a first abutment defining a slot and a second abutment, the first and second abutments being mountable at a substantially fixed location adjacent to the doorway such that the barrier disengages the slot of the first abutment and the second abutment when the door is open, and the barrier engages the slot of the first abutment and the second abutment when the door is closed, wherein the first abutment and the second abutment provide added support to the barrier when the door is closed and the barrier is impacted; and a shear pin that connects the first bracket to the barrier, wherein the shear pin provides a weakest link between the door panel and the barrier.

20. The door of claim 19, wherein the shear pin is a plastic screw.

21. A safety barrier assembly for use with an existing door, comprising:

a first mounting bracket having a first laterally extending flange, wherein the first mounting bracket is to be mounted to a lower section of the existing door;

a second mounting bracket having a second laterally extending flange, wherein the second mounting bracket is to be mounted to the lower section of the existing door opposite the first mounting bracket;

a first abutment having a slot to receive the first laterally extending flange, wherein the first abutment is to be mounted to a floor on a first side of the existing door;

a second abutment having a slot to receive the second laterally extending flange, wherein the second abutment is to be mounted to the floor on a second side of the existing door opposite the first side; and a resilient member to be coupled to and extend between the first and second mounting brackets.

* * * * *